US009077060B2

(12) United States Patent
Nguyen et al.

(10) Patent No.: US 9,077,060 B2
(45) Date of Patent: Jul. 7, 2015

(54) MICROELECTROMECHANICAL SYSTEM (MEMS) RESONANT SWITCHES AND APPLICATIONS FOR POWER CONVERTERS AND AMPLIFIERS

(75) Inventors: Clark Tu-Cuong Nguyen, Oakland, CA (US); Yang Lin, Albany, CA (US); Wei-Chang Li, Berkeley, CA (US); Bongsang Kim, Albuquerque, NM (US)

(73) Assignee: THE REGENTS OF THE UNIVERSITY OF CALIFORNIA, Oakland, CA (US)

( * ) Notice: Subject to any disclaimer, the term of this patent is extended or adjusted under 35 U.S.C. 154(b) by 986 days.

(21) Appl. No.: 12/878,237

(22) Filed: Sep. 9, 2010

(65) Prior Publication Data

US 2011/0067984 A1 Mar. 24, 2011

Related U.S. Application Data

(63) Continuation of application No. PCT/US2009/036852, filed on Mar. 11, 2009.

(60) Provisional application No. 61/035,375, filed on Mar. 11, 2008.

(51) Int. Cl.

| | |
|---|---|
| ***H01P 1/12*** | (2006.01) |
| ***H01H 1/00*** | (2006.01) |
| ***H01H 50/00*** | (2006.01) |

(52) U.S. Cl.

CPC ..... *H01P 1/127* (2013.01); *H01H 50/005* (2013.01); *H01H 1/0036* (2013.01)

(58) Field of Classification Search

USPC ..... 333/186; 335/78; 200/181

See application file for complete search history.

(56) References Cited

U.S. PATENT DOCUMENTS 5,025,346 A * 6/1991 Tang et al. ..... 361/283.1
5,491,604 A * 2/1996 Nguyen et al. ..... 361/278

(Continued)

FOREIGN PATENT DOCUMENTS

WO 2005078509 A3 8/2005

OTHER PUBLICATIONS

Wang, K. et al.—"High-Order Medium Frequency Micromechanical Electronic Filters"—Jour. of Microelectromechanical Systems, vol. 8, No. 4, 1999, pp. 534-557.

(Continued)

*Primary Examiner* — Mohamad Musleh
(74) *Attorney, Agent, or Firm* — John P. O'Banion

(57) ABSTRACT

A modally driven oscillating element periodically contacts one of more electrical contacts, thereby acting as a switch, otherwise known as a resonant switch, or "resoswitch", with very high Q's, typically above 10000 in air, and higher in vacuum. Due to periodic constrained contacting of the contacts, the bandwidth of the switch is greatly improved. One or more oscillating elements may be vibrationally interconnected with conductive or nonconductive coupling elements, whereby increased bandwidths of such an overall switching system may be achieved. Using the resoswitch, power amplifiers and converters more closely approaching ideal may be implemented. Integrated circuit fabrication techniques may construct the resoswitch with other integrated CMOS elements for highly compact switching devices. Through introduction of specific geometries within the oscillating elements, displacement gains may be made where modal deflections are greatly increased, thereby reducing device drive voltages to 2.5 V or lower.

29 Claims, 19 Drawing Sheets

(56) References Cited

U.S. PATENT DOCUMENTS

| | | | | |
|---|---|---|---|---|
| 5,640,133 | A * | 6/1997 | MacDonald et al. | 333/197 |
| 5,914,553 | A * | 6/1999 | Adams et al. | 310/309 |
| 6,613,993 | B1 * | 9/2003 | Strumpler | 200/181 |
| 6,628,177 | B2 * | 9/2003 | Clark et al. | 333/186 |
| 6,975,193 | B2 * | 12/2005 | Knieser et al. | 335/78 |
| 6,985,051 | B2 * | 1/2006 | Nguyen et al. | 333/186 |
| 7,304,556 | B2 * | 12/2007 | Tamura et al. | 335/78 |
| 7,456,698 | B2 * | 11/2008 | Gianchandani et al. | 331/154 |
| 7,911,296 | B2 * | 3/2011 | Nguyen et al. | 333/186 |
| 7,990,232 | B1 * | 8/2011 | Lee | 333/186 |
| 2007/0046398 | A1 | 3/2007 | Nguyen et al. | |
| 2007/0268549 | A1 | 11/2007 | Xiaoyu et al. | |

OTHER PUBLICATIONS

Li, S. et al.—"An MSI Micromechanical Differential Disk-Array Filter"—Dig. of Tech. Papers, the 14th Conf. on Solid-State Sensors & Actuators (Transducers '07), Lyon, Frane, Jun. 11-14, 2007, pp. 307-311.

Wang, J. et al.—"1.51-GHz Nanocrystalline Diamond Micromechanical Disk Resonator with Material-Mismatched Isolating Support"—Proc. 17th Int. IEEE Micro Electro Mechanical Systems Conf., Masstricht, The Netherlands, Jan. 25-29, 2004, pp. 641-644.

Nguyen et al.—"An Integrated CMOS Micromechanical Resonator High-Q Oscillator"—IEEE Jour. of Solid-State Circuits, vol. 34, No. 4, Apr. 1999, pp. 440-455.

Bahl, I.J. et al.—"Class-B Power MMIC Amplifiers with 70 Percent Power-Added Efficiency"—IEEE Trans. on Microwave Theory and Techniques, vol. 37, No. 9, Sep. 1989, pp. 1315-1320.

Aoki, I. et al.—"Fully Integrated CMOS Power Amplifier Design Using the Distributed Active-Transformer Architecture"—IEEE Jour. of Solid-State Circuits, vol. 37, No. 3, Mar. 2002, pp. 371-383.

Huang, W. et al.—"Nickel Vibrating Micromechanical Disk Resonator with Solid Dielectric Capacitive-Transducer Gap"—Proc. IEEE Int. Frequency Control Symp., Miami, Florida, Jun. 5-7, 2006, pp. 839-847.

Nguyen, C.—"MEMS Technology for Timing and Frequency Control"—IEEE Trans. on Ultrasonics, Ferroelectrics, and Frequency Control, vol. 54, No. 2, Feb. 2007, pp. 251-270.

Huang, W. et al.—"Fully Monolithic CMOS Nickel Micromechanical Resonator Oscillator"—MEMS Conf., Tuscon, AZ, Jan. 13-17, 2008, pp. 10-13.

Rebeiz, G.M. et al.—"RF MEMS Switches and Switch Circuits"—IEEE Microwave Magazine, Dec. 2001, pp. 59-71.

Majumder, S.—"A Packaged, High-Lifetime Ohmic MEMS RF Switch"—Tech. Digest, 2003 IEEE MTT-S, vol. 3, Jun. 8-13, 2003, pp. 1935-1938.

Muldavin, J.B. et al.—"High-Isolation Inductively-Tuned X-Band MEMS Shunt Switches"—Tech. Digest, 2000 IEEE MTT-S, Boston, MA, pp. 169-172.

Blackwell, D.A. et al.—"X-Band MMIC Switch with 70 dB Isolation and 0.5dB Insertion Loss"—IEEE 1995, Microwave and Millimeter-Wave Monolithic Circuits Symp., pp. 97-100.

Agilent Technologies—"Agilent Solid State Switches"—downloaded on Dec. 12, 2010 from http://cp.literature.agilent.com/litweb/pdf/5989-5189EN.pdf—pub 2007, pp. 1-12.

Sokal, N.O. et al.—"Class E—A New Class of High-Efficiency Tuned Single-Ended Switching Power Amplifiers"—IEEE Jour. of Solid-State Circuits, vol. SC-10, No. 3, Jun. 1975, pp. 168-176.

Dickson, J.F.—"On-Chip High-Voltage Generation in MNOS Integrated Circuits Using an Improved Voltage Multiplier Technique"—IEEE Jour. of Solid-State Circuits, vol. SC-11, No. 3, Jun. 1976, pp. 374-378.

Lin, Y. et al.—"60-MHz Wine-Glass Micromechanical-Disk Reference Oscillator"—2004 IEEE Int. Solid-State Circuits Conf., MEMS and Sensors, 17.7, pp. 1-10.

Kamitsuna, H. et al—"A Fast Low-Power 4x4 Switch IC Using InP HEMTs for 10-Gbit/s Systems"—Proc. IEEE CSIC, Jul. 2004, pp. 97-100.

WIPO, counterpart PCT Application No. PCT/US2009/036852, International Publication No. WO 2009/148677, dated Dec. 10, 2009, including international search report and written opinion issued on Dec. 30, 2009, pp. 1-71.

* cited by examiner $$f_o = \frac{1}{2\pi}\sqrt{\frac{k}{m}} \propto \sqrt{\frac{E}{\rho}} \cdot \frac{1}{R}$$

$E$ ≡ Young's Modulus
$\rho$ ≡ Density
$R$ ≡ Disk Radius

436

MICROELECTROMECHANICAL SYSTEM (MEMS) RESONANT SWITCHES AND APPLICATIONS FOR POWER CONVERTERS AND AMPLIFIERS

CROSS-REFERENCE TO RELATED APPLICATIONS

This application a 35 U.S.C. §111(a) continuation of PCT international application serial number PCT/US2009/036852, filed on Mar. 11, 2009, incorporated herein by reference in its entirety, which is a nonprovisional of U.S. provisional patent application Ser. No. 61/035,375 filed on Mar. 11, 2008, incorporated herein by reference in its entirety. Priority is claimed to each of the foregoing applications.

The above-referenced PCT international application was published as PCT International Publication No. WO 2009/148677 published on Dec. 10, 2009 and republished on Feb. 25, 2010, and is incorporated herein by reference in its entirety.

STATEMENT REGARDING FEDERALLY SPONSORED RESEARCH OR DEVELOPMENT

This invention was made with Government support under Grant No. N66001-08-1-2025, awarded by the Defense Advanced Research Projects Agency (DARPA). The Government has certain rights in this invention.

INCORPORATION-BY-REFERENCE OF MATERIAL SUBMITTED ON A COMPACT DISC

Not Applicable

NOTICE OF MATERIAL SUBJECT TO COPYRIGHT PROTECTION

A portion of the material in this patent document is subject to copyright protection under the copyright laws of the United States and of other countries. The owner of the copyright rights has no objection to the facsimile reproduction by anyone of the patent document or the patent disclosure, as it appears in the United States patent and Trademark Office publicly available file or records, but otherwise reserves all copyright rights whatsoever. The copyright owner does not hereby waive any of its rights to have this patent document maintained in secrecy, including without limitation its rights pursuant to 37 C.F.R. §1.14.

A portion of the material in this patent document is also subject to protection under the maskwork registration laws of the United States and of other countries. The owner of the maskwork rights has no objection to the facsimile reproduction by anyone of the patent document or the patent disclosure, as it appears in the United States Patent and Trademark Office publicly available file or records, but otherwise reserves all maskwork rights whatsoever. The maskwork owner does not hereby waive any of its rights to have this patent document maintained in secrecy, including without limitation its rights pursuant to 37 C.F.R. §1.14.

BACKGROUND OF THE INVENTION

1. Field of the Invention

This invention pertains generally to microelectromechanical switches, and more particularly to resonant microelectromechanical switches.

2. Description of Related Art

Semiconductor switching applications suffer from a great number of limitations, including drive capacitance, on resistance, low maximum voltage limits that require impedance matching networks, relatively slow rise times during which power dissipation can be quite high, and reduction of overall switched power converter or amplifier performance by 10% or more due to overall combined losses. Higher efficiency power converters and amplifiers are needed to reduce battery drain in portable devices, and simply for greater efficiency and reduced power consumption.

BRIEF SUMMARY OF THE INVENTION

An aspect of the invention is an oscillating switch apparatus that may comprise: a) a substrate, and b) means for switching disposed on the substrate. The means for switching may comprise: a) a driven element that oscillates; b) one or more switch contacts proximal to the driven element; c) one or more drive electrodes proximal to the driven element; d) wherein the driven element contacts at least one of the switch contacts upon a sufficient amplitude oscillation imparted by the drive electrodes.

A power amplifier may be comprised of at least one of the oscillating switch apparatuses above. Alternatively, power converter may be comprised of at least one of the oscillating switch apparatuses above. Alternatively, a filter network may be comprised of the switch apparatuses above.

The driven element may comprise: a) a conductor spaced above the substrate; b) one or more electrodes that act to impart a vibration on the conductor; c) one or more contact electrodes that are periodically electrically connected to the conductor within a bandwidth of vibration of the conductor.

The means for switching may comprise: a) a driven element that oscillates, wherein the driven element is spaced apart from the substrate, and connected to the substrate; b) two switch contacts proximal to the driven element; c) two drive electrodes proximal to the driven element; d) wherein the two drive elements generate oscillations in the driven element; and e) the oscillations cause modal deflections in the driven element, whereby the driven element periodically electrically connects the two switch contacts.

The driven element may be driven within its operational bandwidth to periodically electrically connect the two switch contacts. Additionally, the driven element may be polysilicon, doped polysilicon, or a metal.

The driven element may be driven with a voltage amplitude of less than or equal to 3 volts. During life testing, the driven element was driven with voltages as low as 2.5 V. During testing, voltages as low as 0.400 volts were successfully used.

The oscillating switch apparatus may have a switch closure time of less than 10 ns, less than 5 ns, or even approximately 4 ns.

There may be a gap between the driven element and the drive electrode of 150 nm or less, or 100 nm or less. Similarly, there may be a gap between the driven element and the switch contacts of 150 nm or less, or 100 nm or less.

Absent displacement gain elements, the gaps between the control and switch element(s) may be different, with the control gaps larger. By utilizing displacement gain elements, the gaps between the control and switch element(s) may be the same, or substantially the same to within 5-10%.

The switch apparatus driven element may have an unconstrained resonant frequency between 61 MHz and 2.0 GHz. By unconstrained, it is meant that the driven element would not contact any contact or other structure in unconstrained resonance during a lower resonant forcing function.

The switch apparatus may have a Q of 10000 or greater in air, or 12500 or greater in vacuum.

The oscillating switch may operate in an ambient gas selected from the group of gasses consisting of: vacuum, air, nitrogen, argon, $SF_6$.

The oscillating switch apparatus may be monolithically fabricated with one or more CMOS elements during a single fabrication sequence.

The driven element may be substantially circular, and may oscillate in wine-glass mode. The driven element may be substantially flat. In order to implement displacement gain elements, the otherwise substantially flat driven element may have designed elevations, where displacement gain is achieved.

The driven element may comprise one or more displacement gain elements. Such displacement gain elements may be circular, obround, or other custom geometries, whereby vibration amplitude is anisotropically increased during operation.

A cascaded resonator may comprise two or more of the individual oscillating resoswitches described above, interconnected with resonant structures, wherein the bandwidth of the cascaded resonator exceeds the bandwidth of the individual oscillating switch apparatus. The cascaded resonator may or may not have displacement gain elements, or only some of the resonators may have such displacement gain elements. Typically, the interconnect between resoswitch stages is a $\lambda/2$ structure, where $\lambda$ is a center frequency between the two resonant stages.

The cascaded resonator above may also be used to effect a multi pole or zero filter based on constructive and destructive interference of the various resonant structures. In the filter application, switching may or may not be used to implement digital filters or analog filters, respectively. Where switching is not used, noncontact signal outputs may be obtained through biasing of the vibrational element(s) with capacitive coupling to one or more output contact(s).

Another aspect of the invention is an oscillating switch, which may comprise: a) a substrate; b) one or more driven elements spaced above and connected to the substrate; c) one or more drive electrodes proximal to at least one driven element; d) one or more switch contacts proximal to at least one driven element; e) wherein at least one drive electrode oscillates at least one driven element; f) wherein at least one driven element periodically electrically connects with one or more switch contacts.

The oscillating switch may comprise: a) a physical connection between two or more of the driven elements, wherein the oscillation of at least one of the driven elements is transmitted to at least one other driven element. The physical connection may be disposed above the substrate, and may be as simple as a beam. The beam may be either an electrical conductor, or an insulator.

A still further aspect of the invention is a method of oscillating switching, which may comprise: a) providing an oscillating driven element; b) selectively oscillating the driven element; c) periodically contacting one or more switching contacts with the driven element, wherein, during contact, the oscillating driven element and the contacts form an electrically conductive path. The selectively oscillating step may comprise oscillating in a wine-glass mode.

The selectively oscillating step may comprise: a) applying one sinusoidal voltage to two drive electrodes to achieve periodic contacting of the switching contacts with the driven element; b) wherein the switch is periodically "on".

Alternatively, the selectively oscillating step may comprise: a) applying differential sinusoidal voltages to two drive electrodes to prevent periodic contacting of the switching contacts with the driven element; b) wherein the switch is "off".

The method of oscillating switching may comprise: a) providing a second driven element vibrationally connected to the driven element; b) applying a voltage to the drive electrodes of both the driven element and the second driven element; c) thereby broadening the bandwidth of the oscillating switch.

Further aspects of the invention will be brought out in the following portions of the specification, wherein the detailed description is for the purpose of fully disclosing preferred embodiments of the invention without placing limitations thereon.

BRIEF DESCRIPTION OF THE SEVERAL VIEWS OF THE DRAWING(S)

The invention will be more fully understood by reference to the following drawings which are for illustrative purposes only:

Figure 6A:
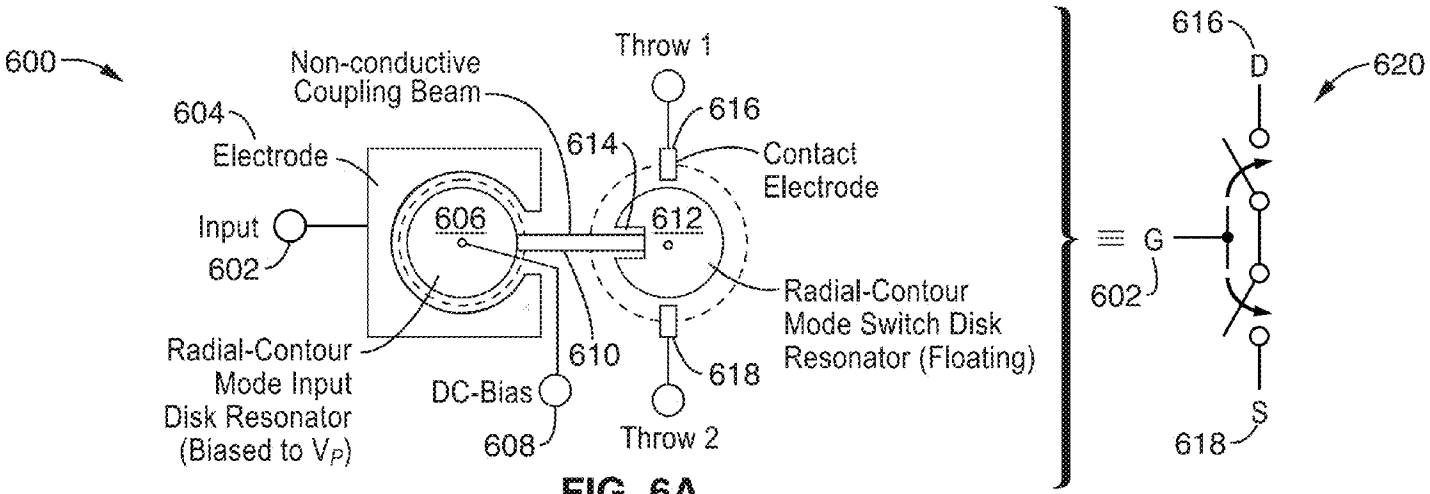
FIG. 6A shows an input radial-contour mode vibrating disk coupled via a non-conductive beam to an output disk at a notched location.
Figure 6B:
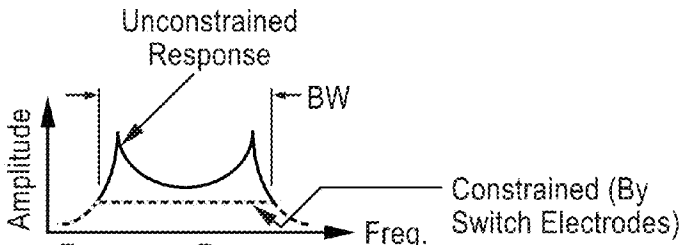

FIG. 6B shown the composite frequency response of the resoswitch of FIG. 6A.

Figure 7C:
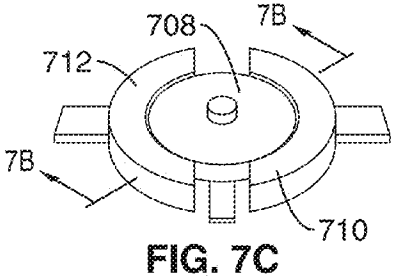
Figure 7A:
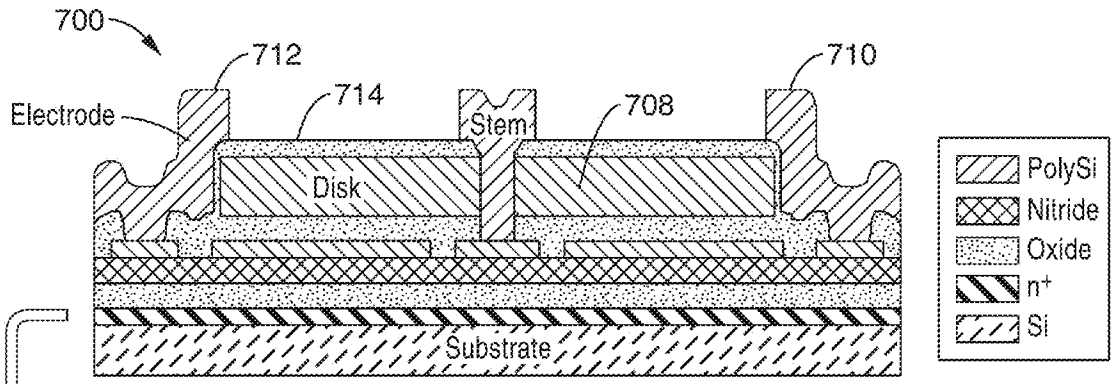

FIG. 7A is a cross section of the device of FIG. 7C prior to the removal of the oxide layer, with the materials listed so as to facilitate lithographic mass fabrication.

Figure 7B:
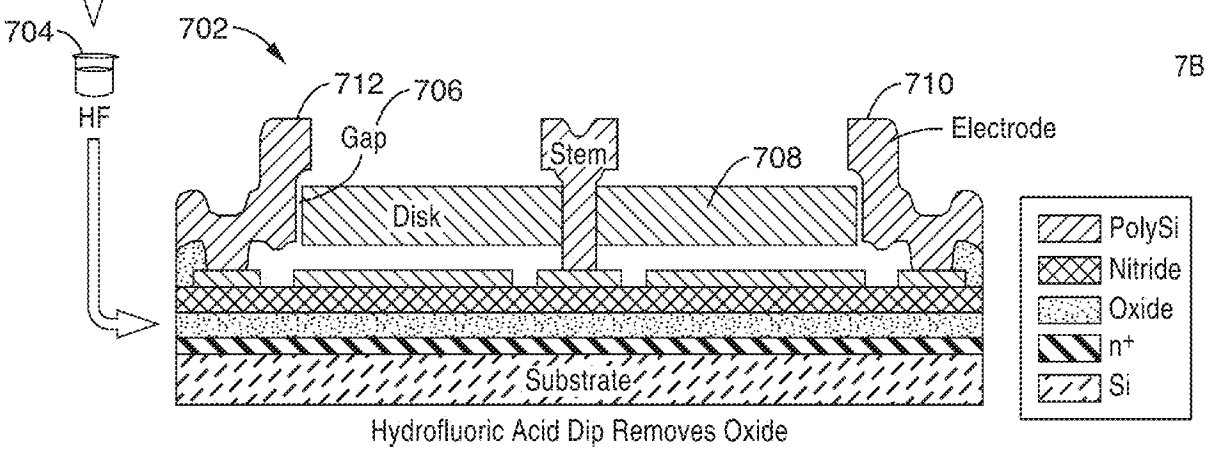

FIG. 7B is a cross section of the device of FIG. 7C after the removal of the oxide layer by immersion in an HF bath.

FIG. 7C is a representative single disk resoswitch.

Figure 8:
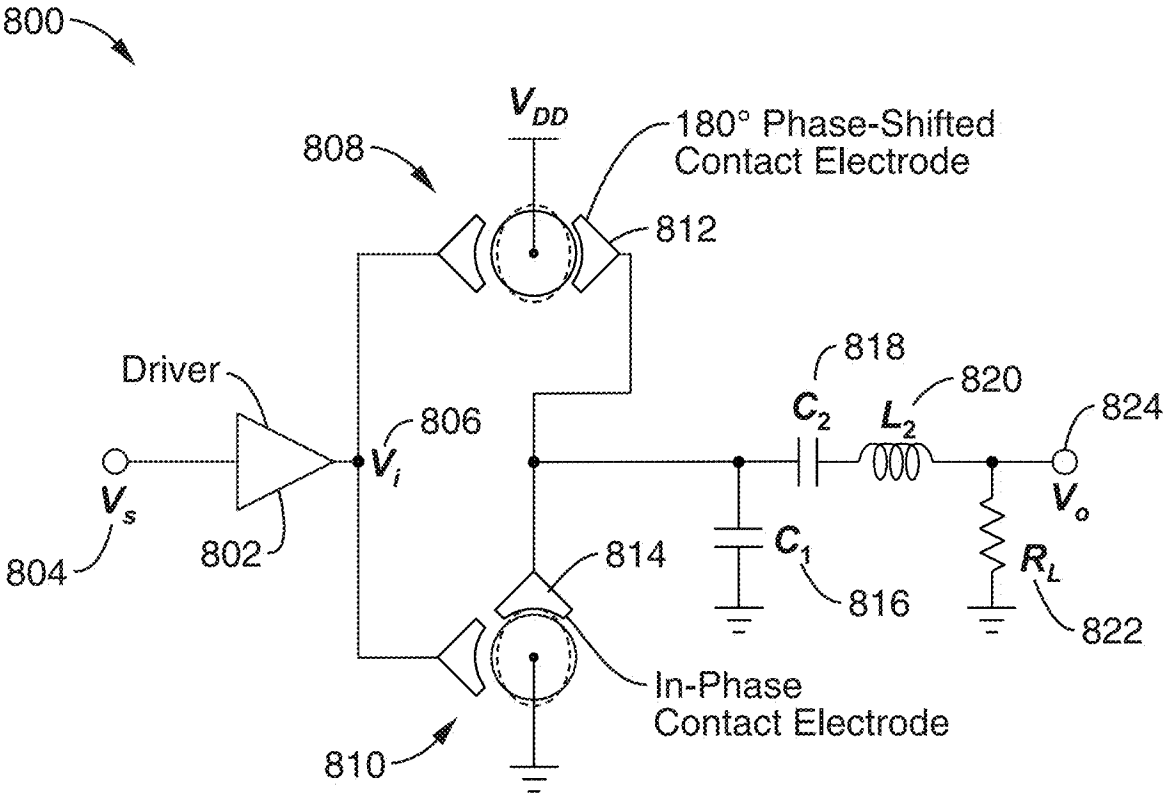

FIG. 8 is a schematic of a Class D amplifier shown realized with resoswitches of 90° and 180° phasings.

Figure 9:
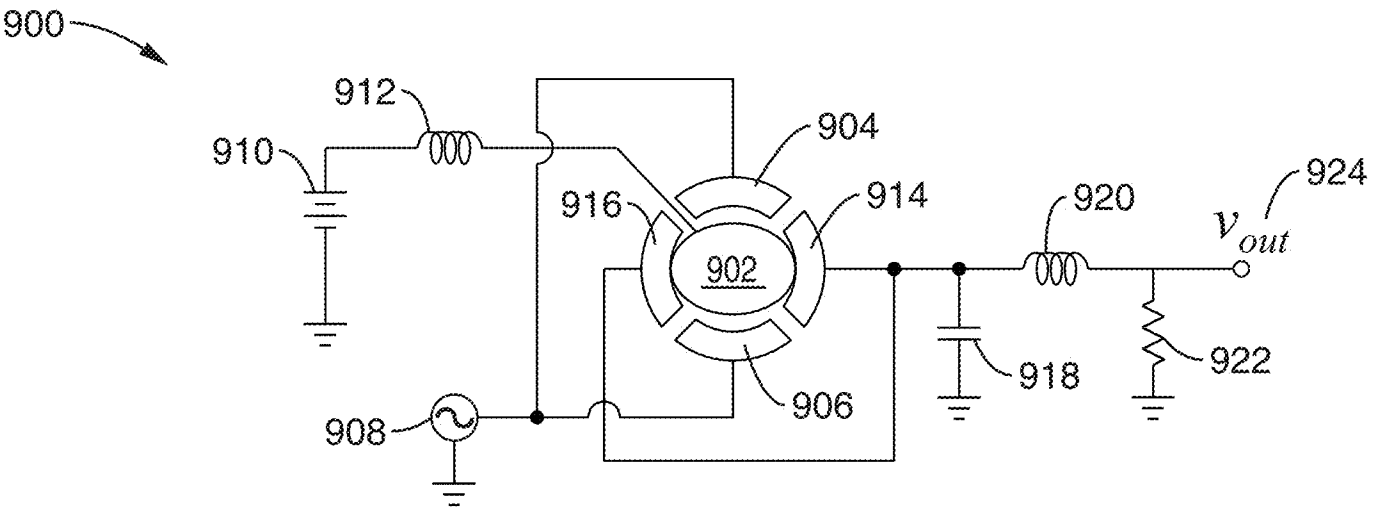

FIG. 9 is a schematic of a wine-glass disk resoswitch structure used in an example circuit diagram of a Class-E power amplifier utilizing this resoswitch.

Figure 10A:
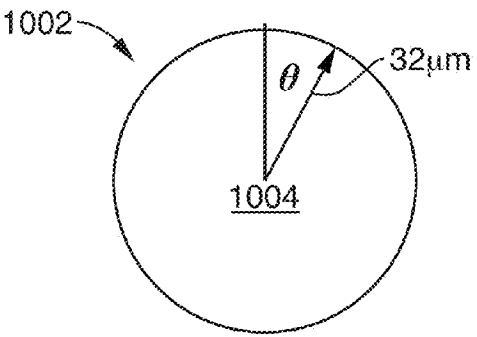

FIG. 10A is a top view of a conventional disk resonator.

Figure 10B:
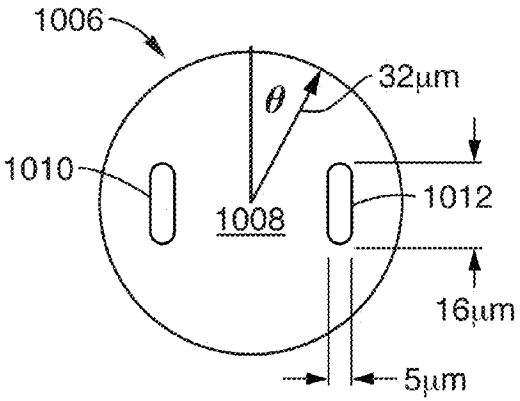

FIG. 10B is a top view of a conventional disk resonator with two obround slots acting as displacement gain features.

Figure 10C:
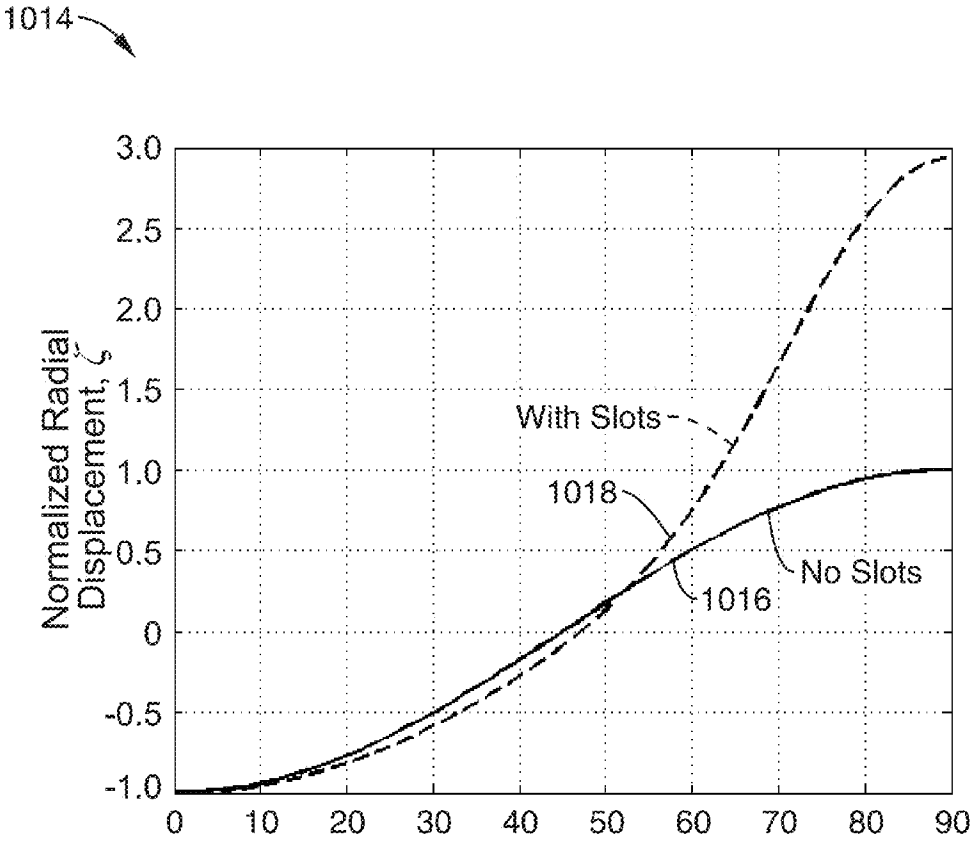

FIG. 10C is a plot of mode shape comparison between the conventional disk resonator of FIG. 10A and the displacement gain resonant disk of FIG. 10B, where radial displacements are normalized to the maximum displacement of the conventional disk resonator.

Figure 10D:
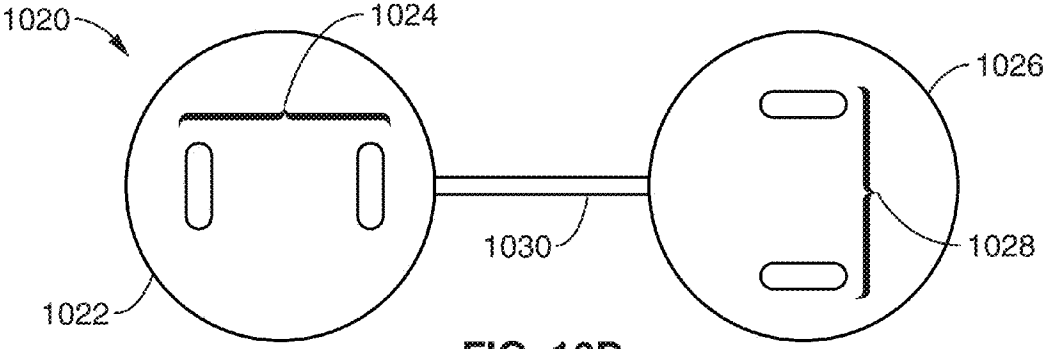

FIG. 10D is a top view of a half-wave beam-coupled cascade of two displacement gain resonator stages of FIG. 10B.

Figure 10F:
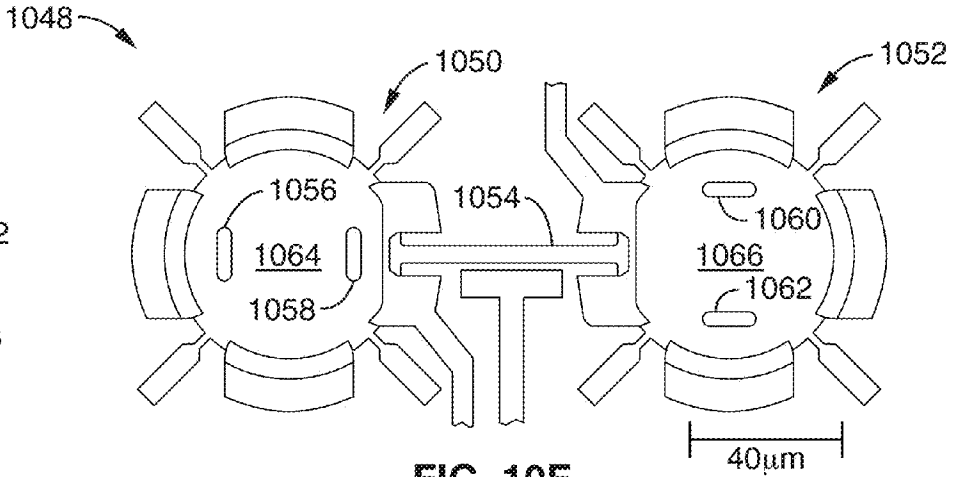
Figure 10E:
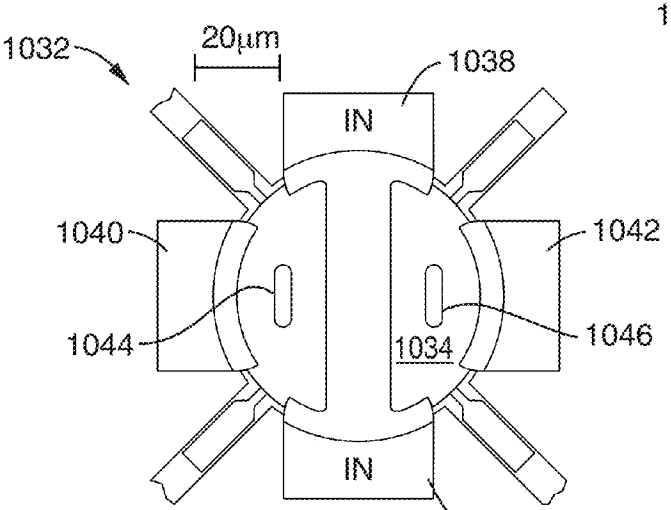

FIG. 10E is a line drawing of a top view Scanning Electron Microscope (SEM) image of the fabricated device depicted in FIG. 10B.

FIG. 10F is a line drawing of a top view Scanning Electron Microscope (SEM) image of the fabricated two stage cascaded displacement gain device of FIG. 10D.

Figure 5B:
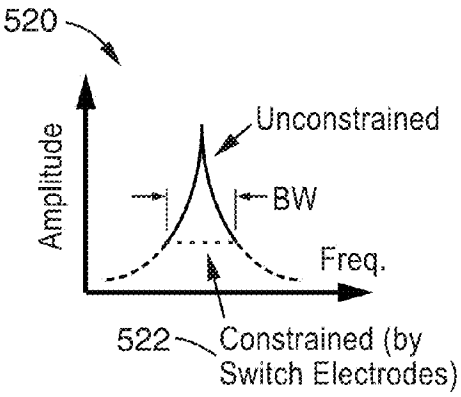
FIG. 5B is a plot of the frequency response of the device of FIG. 5A, showing the increase in bandwidth that the motion constraint (electrical switch contacts) mechanism provides.
Figure 5A:
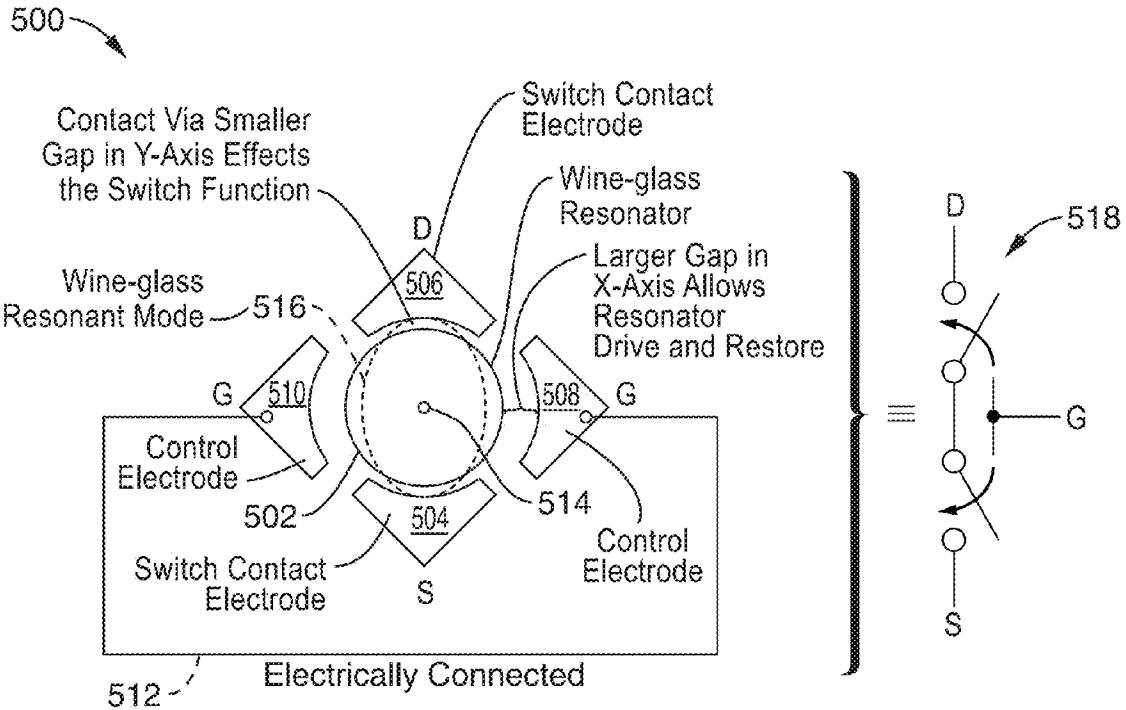
FIG. 5A is a simplified diagram of one rendition of a MEMS resoswitch based on a wine-glass disk resonance, as well as a circuit element depicting the switching characteristics of the resoswitch.
Figure 5D:
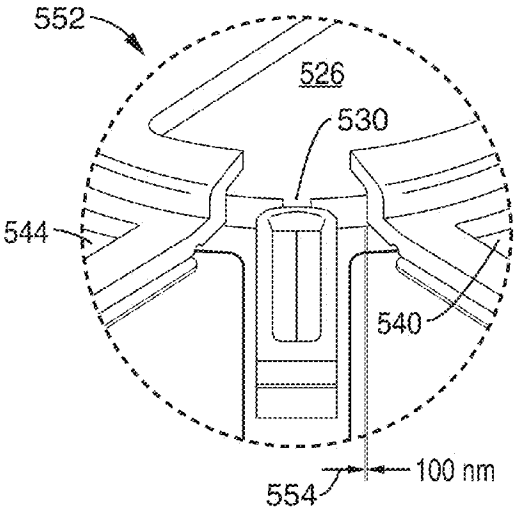
FIG. 5D shows a blown up section of the resonator disk clearing the switch contact structure by a mere 100 nm distance.
Figure 5C:
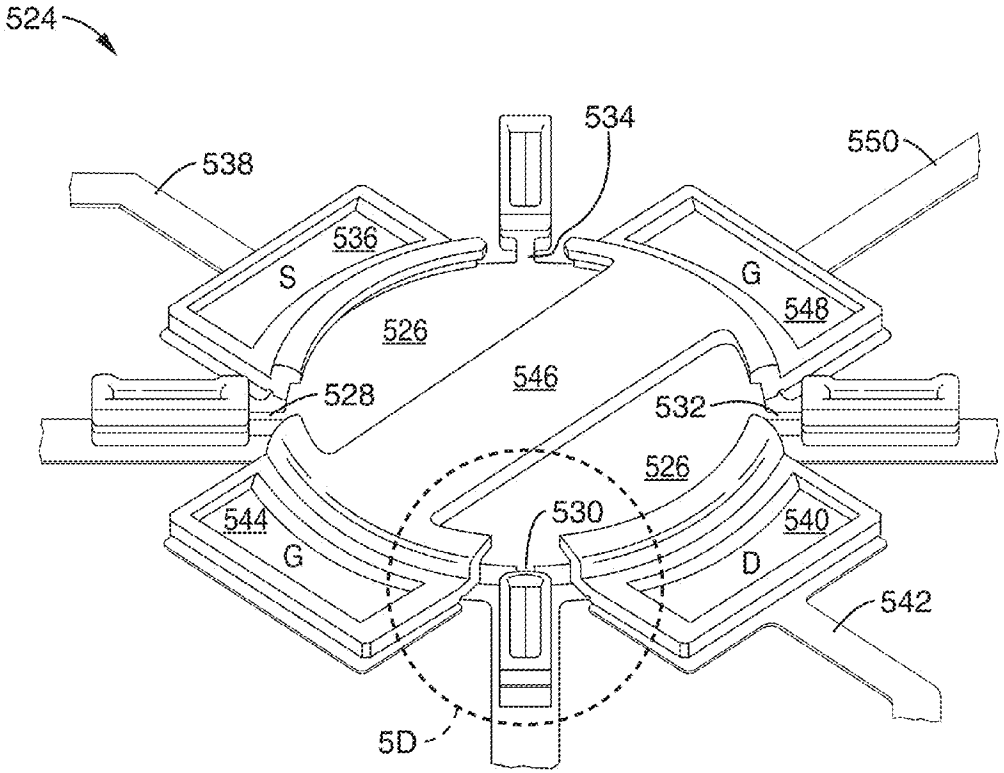
FIG. 5C shows a line drawing of a Scanning Electron Microscope (SEM) image of a fabricated device of FIG. 5A, showing the bridging electrical connection above the vibrating element and between the control electrodes.
Figure 11A:
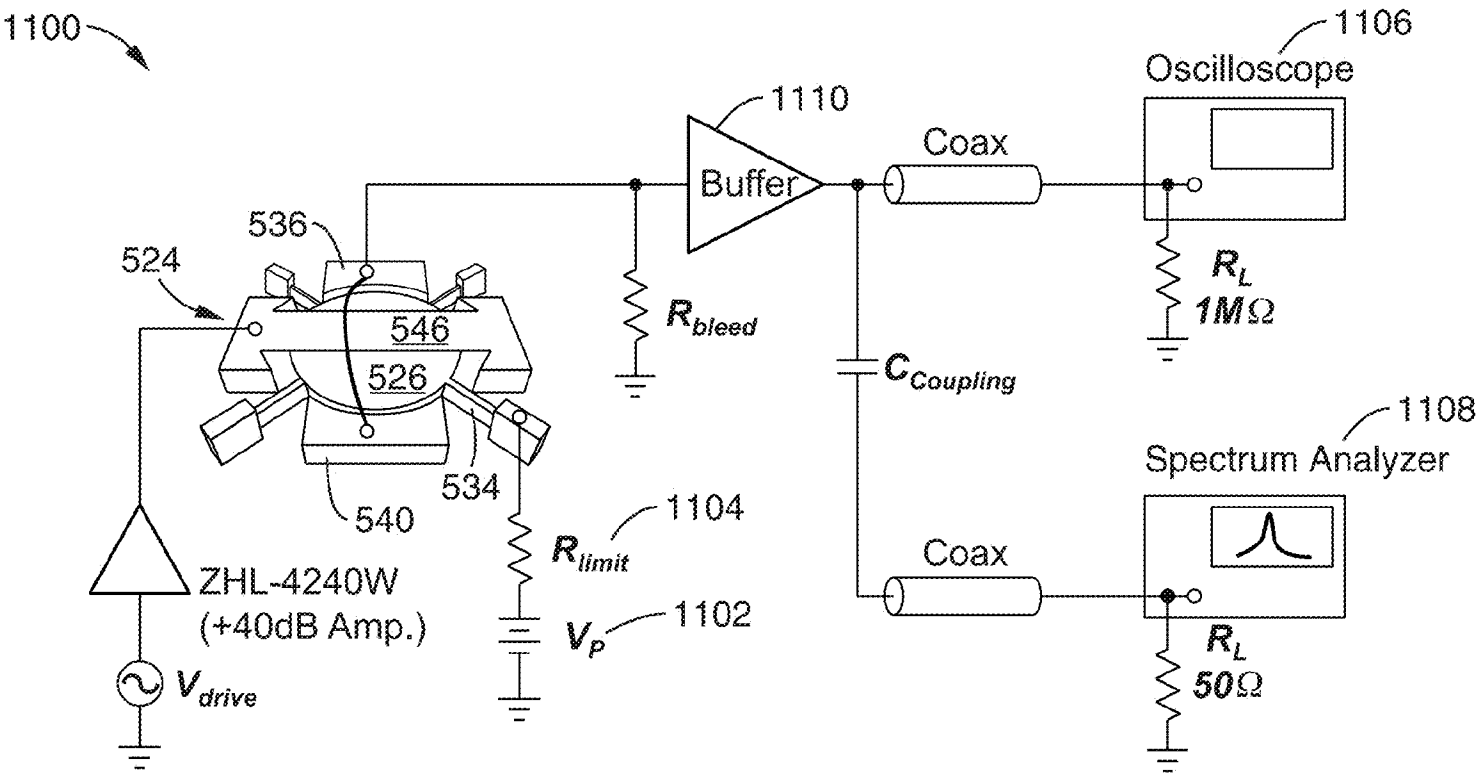

FIG. 11A is a schematic of an experimental setup for the time and frequency domain testing of the resoswitch device of FIG. 5C.

Figure 11B:
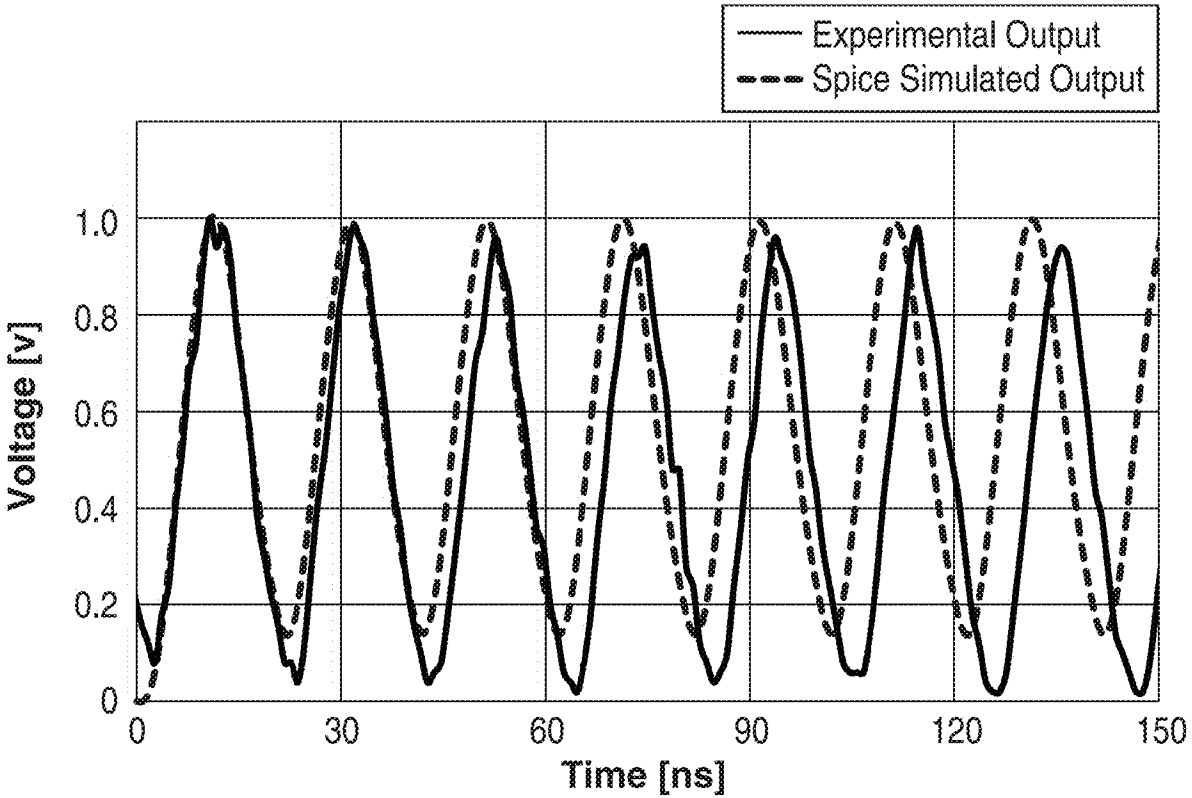

FIG. 11B is plot of the oscilloscope (i.e., time domain) waveform and SPICE simulated prediction seen at the resoswitch output node of FIG. 11A when driven by a resonance input signal with 2.5V amplitude.

Figure 11C:
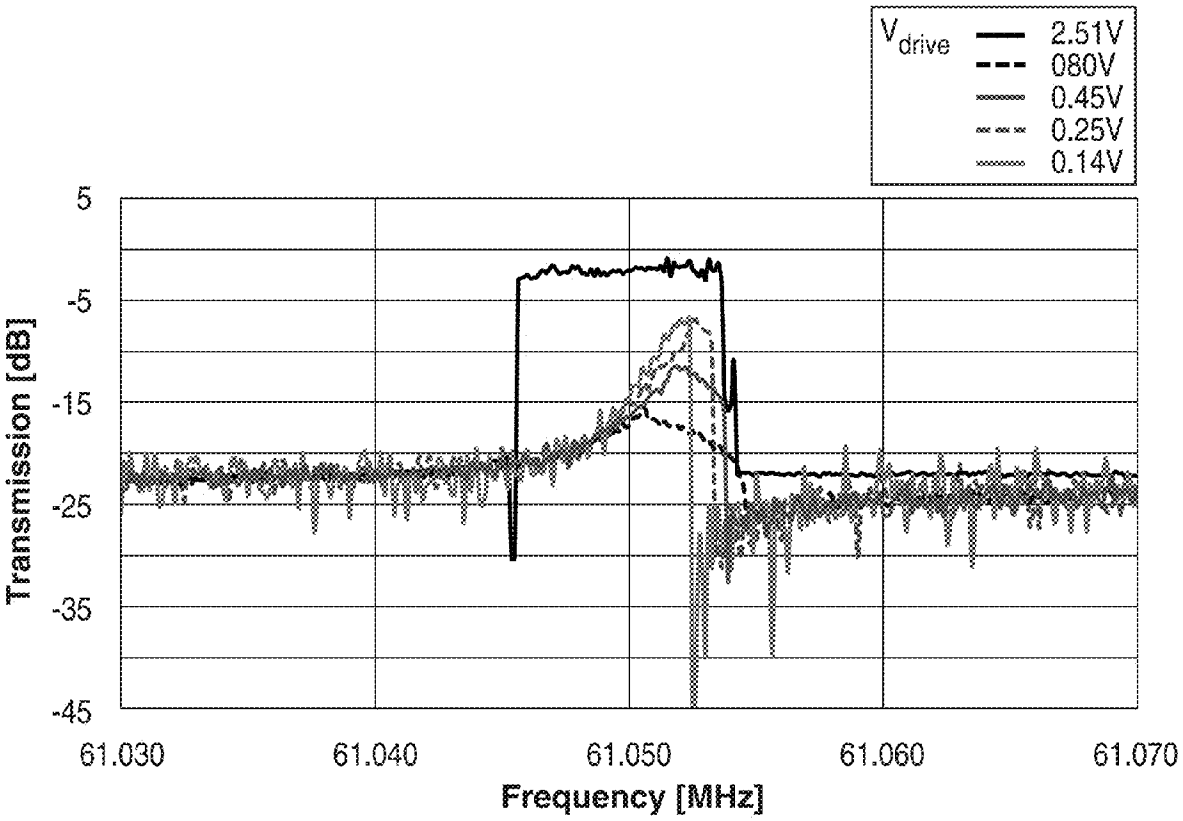

FIG. 11C is a plot of the frequency response (in vacuum) transmission as measured by a network analyzer of the direct contact version of the resoswitch of FIG. 11A for varying resonance input ac voltage amplitudes.

Figure 11D:
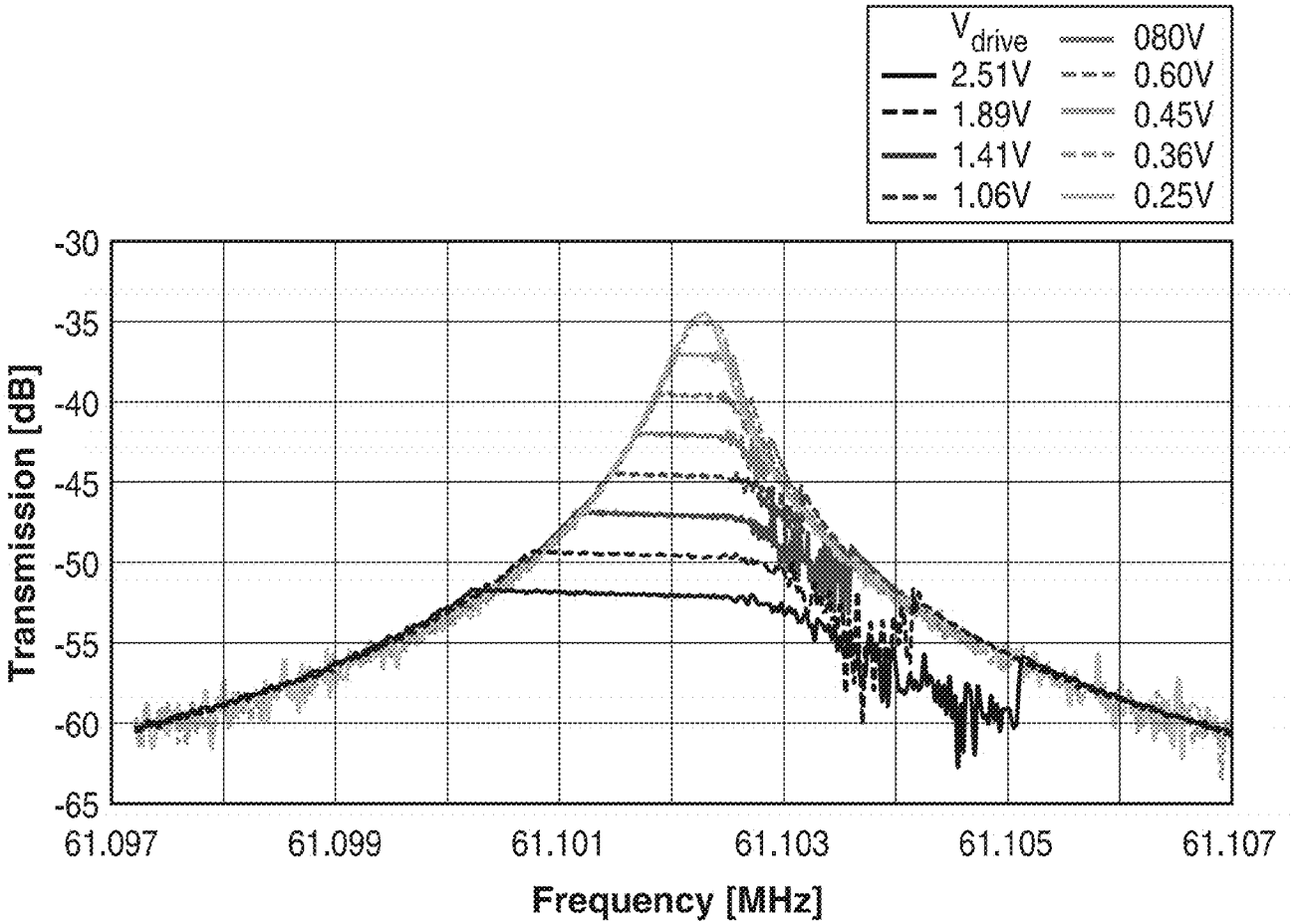

FIG. 11D is a plot of the frequency response (in vacuum) transmission as measured by a network analyzer of the direct contact version of the resoswitch of FIG. 11A for varying resonance input ac voltage amplitudes.

Figure 11E:
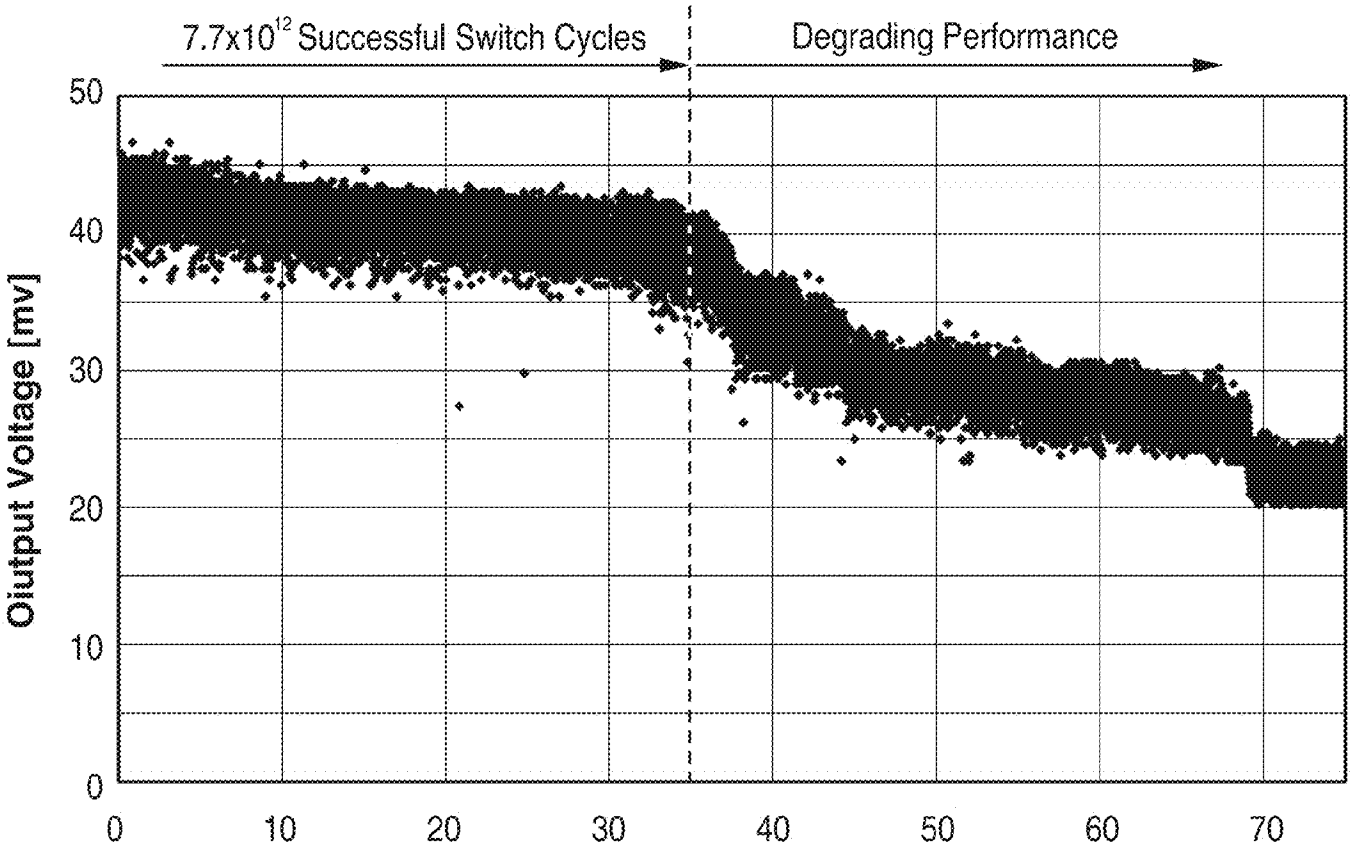

FIG. 11E is a plot of a lifetime test of the polysilicon resoswitch of FIG. 11A.

DETAILED DESCRIPTION OF THE INVENTION

Definitions

The following terms are used herein and are thus defined to assist in understanding the description of the invention(s). Those having skill in the art will understand that these terms are not immutably defined and that the terms should be interpreted using not only the following definitions but variations thereof as appropriate within the context of the invention(s).

"Obround" means a shape consisting of two semicircles connected by parallel lines tangent to their endpoints.

"Displacement Gain element" means a feature on a vibrational geometry that amplifies modal vibration anisotropically. For example, in a flat circular geometry, slots (removed material) axisymmetrically spaced near the circumference amplify a vibrational modal amplitude above the slots. Another example element would be the building up (adding material) of vibrating material upon the surface of a vibrating element, such as an increased thickness of the structure, so as to skew the modal vibration response so that vibrational amplitudes in one axis differs (has gain) from vibrational amplitudes (displacement) in another axis. Of course, material may be both removed and added to obtain even greater displacement gain. One goal of a displacement gain element might be to obtain preferential contact of an oscillating element on contact electrode(s), while not contacting drive electrode(s), preferably with a constant non-vibrating gap between the structure and contact electrode(s) and drive electrode(s).

Referring more specifically to the drawings, for illustrative purposes the present invention is embodied in the apparatus generally shown in FIG. 1A through FIG. 11E. It will be appreciated that the apparatus may vary as to configuration and as to details of the parts, and that the method may vary as to the specific steps and sequence, without departing from the basic concepts as disclosed herein.

Introduction

The invention disclosed here is used to explore power conversion and amplification methods that attain power added efficiencies close to the 100% theoretically available from (but never achieved by) switching (Class D, E, or F) power amplifiers via use of GHz vibrating resonator-switches with switch characteristics substantially more ideal than their transistor-based counterparts. The resonator-switch based approach to power amplifier realization is expected to yield efficiencies substantially higher than the 40-70% reported for corresponding semiconductor switch-based versions, perhaps approaching values exceeding 95%. An important element in attaining such a high efficiency is the use of a new microelectromechanical system (MEMS) device, dubbed a "resonator-switch" or "resoswitch", which combines the functions of high-frequency vibrating micromechanical resonance with low loss switching.

Compared with the semiconductor switches in current use, the resoswitch device achieves superior power added efficiency (PAE) by: (1) greatly reducing switch series resistance and effective capacitance, (2) by extending the voltage and temperature ranges sustainable by the switching devices, and (3) by allowing the use of alternative (e.g., non-conductive) substrates. Among the above benefits, the substantially lower input capacitance, higher Q, and higher voltage capability (versus transistors) of the proposed micromechanical resoswitch contribute most to the higher power added efficiency. Specifically, the combination of lower input capacitance and higher Q greatly reduces the power consumed by the driver stage preceding the resoswitch; and higher voltage allows delivery of the needed power to a larger load resistance, where the increased resistance significantly reduces losses to parasitic resistors, since these parasites would now comprise a much smaller fraction of the total output resistance.

Background

Given that transmit power consumption often governs the ultimate battery lifetime of portable wireless communication devices, the efficiencies of the transmit power amplifiers used in such devices are of great importance. Ultimately, the efficiencies of such transmit power amplifiers are set by the capabilities of the semiconductor transistor device(s) that drive them. The most efficient power amplifier configurations operate their semiconductor transistors as switches that, if the switches were ideal, would not dissipate any power, making these amplifiers theoretically capable of achieving 100% efficiency.

Unfortunately semiconductor transistor switches are not sufficiently ideal to allow such power amplifiers to actually achieve their possible efficiency potential. Rather, the semiconductor transistor switches have finite series resistance, large input capacitance, nonlinear drain capacitance, substrate losses, voltage limitations, and temperature dependencies, all of which contribute to a lower effective efficiency than would otherwise be achievable if a more perfect switch device were available.

The resoswitch described here makes possible power added efficiencies closer to the 100% theoretical expectation for such switching power amplifier configurations by reducing or eliminating many of the deficiencies of semiconductor transistor switches. By making possible efficiencies exceeding 95%, the resoswitch would finally overcome a long-standing impasse in power amplifier advancement that could open many new opportunities that include not only an increase in the talk-time of portable battery-powered wireless transceivers, but also a significant increase in the range of high power transmitters. In particular, the increased efficiency afforded by use of the resoswitch reduces the power dissipated in the amplifier itself, thereby lowering amplifier operational temperatures and consequently allowing a further increase in output power, which is further accommodated by the higher voltage handling capability and better temperature resilience of the micromechanical resonator switching device. The result resoswitch high power transmitters would result in much smaller and lighter form factors than presently achievable.

Technical Rationale

Figure 1A:
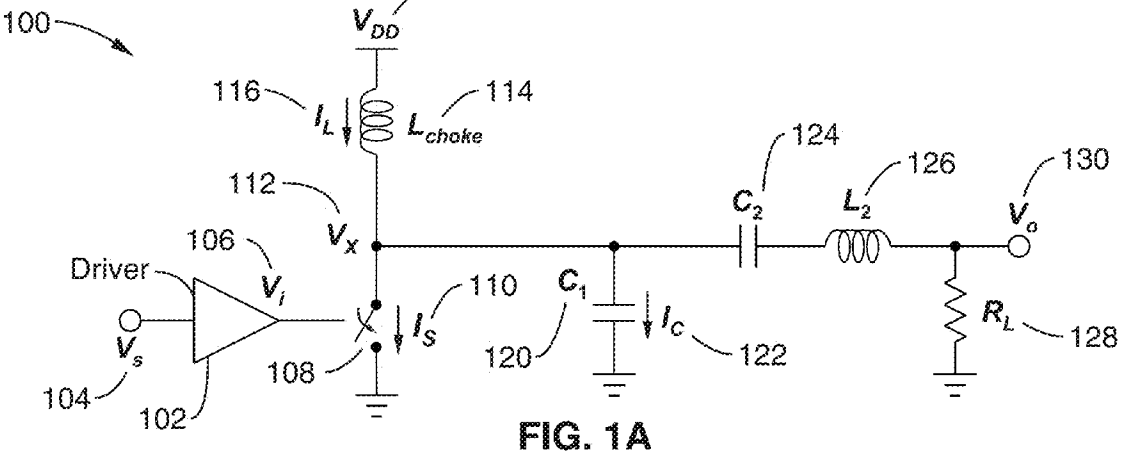
FIG. 1A is a schematic of an ideal Class E power amplifier, with an ideal switch.
Figure 1B:
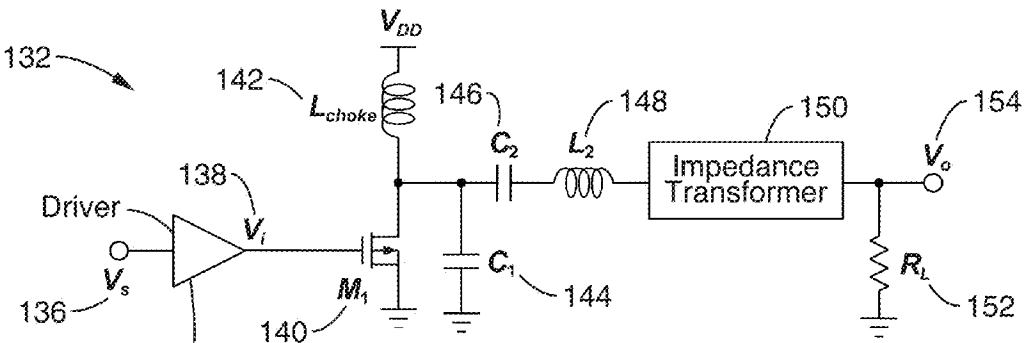
FIG. 1B is a schematic of a conventional transistor Class E power amplifier, with a MOSFET switch.

The efficiency benefits attained via use of a vibrating micromechanical resonator switch (resoswitch) in a Class D or E power amplifier configuration are perhaps best conveyed by direct comparison with corresponding transistor switch-based versions. Pursuant to this, FIG. 1A presents the circuit topologies of an ideal Class E power amplifier circuit that has a perfect switch; FIG. 1B presents a conventional Class E amplifier using a traditional transistor switch device; and FIG. 1C presents a simplified rendition of a proposed Class E amplifier utilizing a vibrating micromechanical resonator switch (resoswitch).

Referring now to FIG. 1A, the idealized Class E amplifier is shown 100 with a driver 102 controlled by a voltage source $V_s$ 104, producing an input voltage $V_i$ 106 to the ideal switch 108, which is grounded. When the ideal switch 108 is in a closed position (not shown here), a source current $I_s$ 110 flows through the switch to ground. When the ideal switch 108 is in an open position (shown here), a voltage $V_x$ 112 is present at one end of the ideal switch 108. Voltage $V_x$ is produced through the action of inductor $L_{choke}$ 114 flowing current $I_L$ 116 flowing from the source supply voltage $V_{DD}$ 118. Voltage $V_x$ 118 and current $I_L$ 116 are in turn connected to the remainder of the circuit as follows. $C_1$ 120 is electrically connected with voltage $V_x$ 112, and through $C_1$ 120 flows a current $I_C$ 122. $C_1$ 120 connects in series with $C_2$ 124 and $L_2$ 126 to load resistance $R_L$ 128, where the output voltage $V_O$ 130 exists.

Referring now to FIG. 1B, the MOSFET Class E amplifier is shown 132 with a driver 134 controlled by a voltage source $V_s$ 136, producing an input voltage $V_I$ 138 to the n-channel MOSFET switch 140, which continues to ground. When the MOSFET switch 140 is in an operationally closed position, a current flows from the supply voltage $V_{DD}$ through inductor $L_{choke}$ 142, then through the MOSFET switch 140 to ground. The remainder of the circuit as follows: $C_1$ 144 is electrically connected with the output of $L_{choke}$ 142, and $C_1$ 144 flows a current to ground. $C_1$ 144 connects in series with $C_2$ 146 and $L_2$ 148 to a load impedance transformer 150 to resistance $R_L$ 152, where the output voltage $V_O$ 154 exists.

Figure 1C:
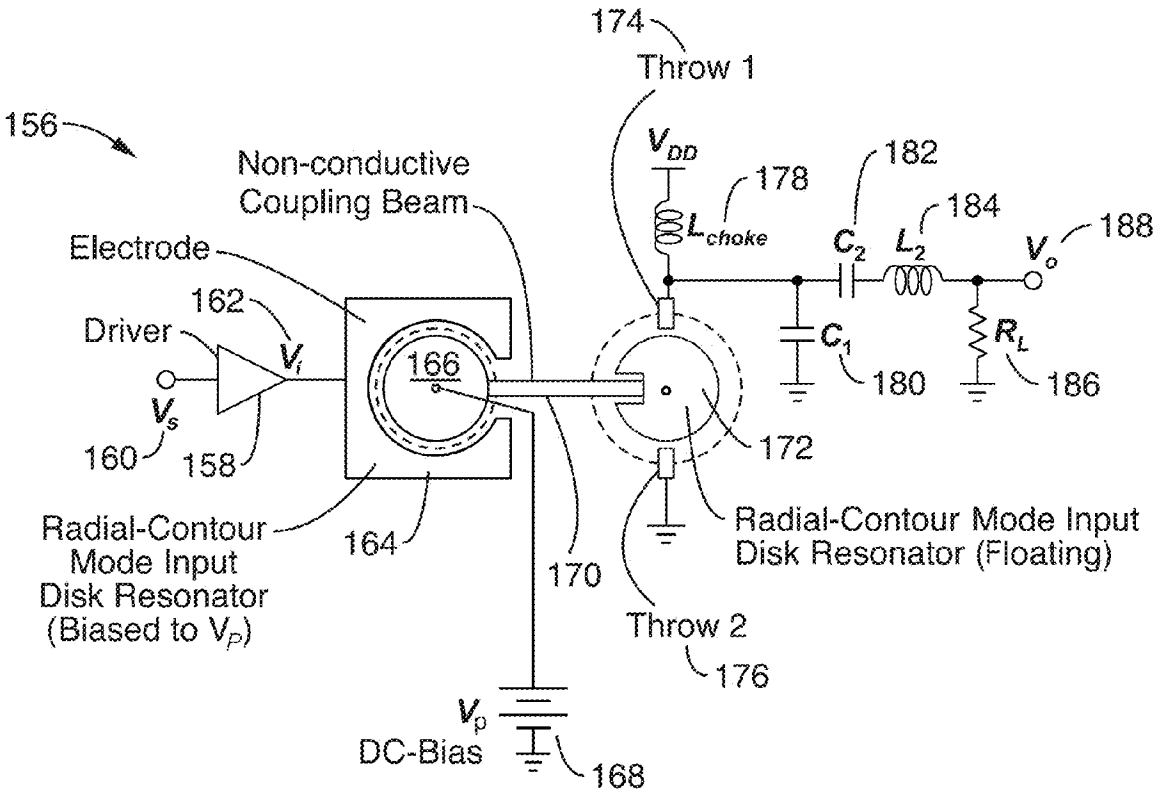
FIG. 1C is a schematic of Class E power amplifier, with a MEMS vibrating resonator switch (or "resoswitch").

Referring now to FIG. 1C, one embodiment of the resoswitch Class E amplifier is shown 156 with a driver 158 controlled by a voltage source $V_s$ 160, producing an input voltage $V_I$ 162 to the resoswitch electrode 164. The resoswitch electrode 164 partially surrounds a radial-contour mode disk resonator 166 to which is supplied a DC-bias source $V_P$ 168. A nonconductive mechanical coupling beam 170 is attached to the radial-contour mode disk resonator 166 at one end, and also connected to a radial-contour mode input disk resonator 172, which is electrically floating at rest. When the radial-contour mode disk resonator 166 is excited at resonance, nonconductive mechanical coupling beam 170 transmits vibrational energy to the radial-contour mode input disk resonator 172. At the correct resonant condition (controlled by the voltage source $V_s$ 160), disk resonator 172 may simultaneously make contact between Throw1 174 and Throw2 176, thereby acting as an essentially ideal (absent switch resistance) switch in the closed position, whereby a current flows from the supply voltage $V_{DD}$ through inductor $L_{choke}$ 178, then through the radial-contour mode input disk resonator 172 acting as a switch to ground. The remainder of the circuit as follows: $C_1$ 180 is electrically connected with the output of $L_{choke}$ 178, and $C_1$ 180 flows a current to ground. $C_1$ 180 connects in series with $C_2$ 182 and $L_2$ 184 to load resistance $R_L$ 186, where the output voltage $V_O$ 188 exists.

Figure 2:
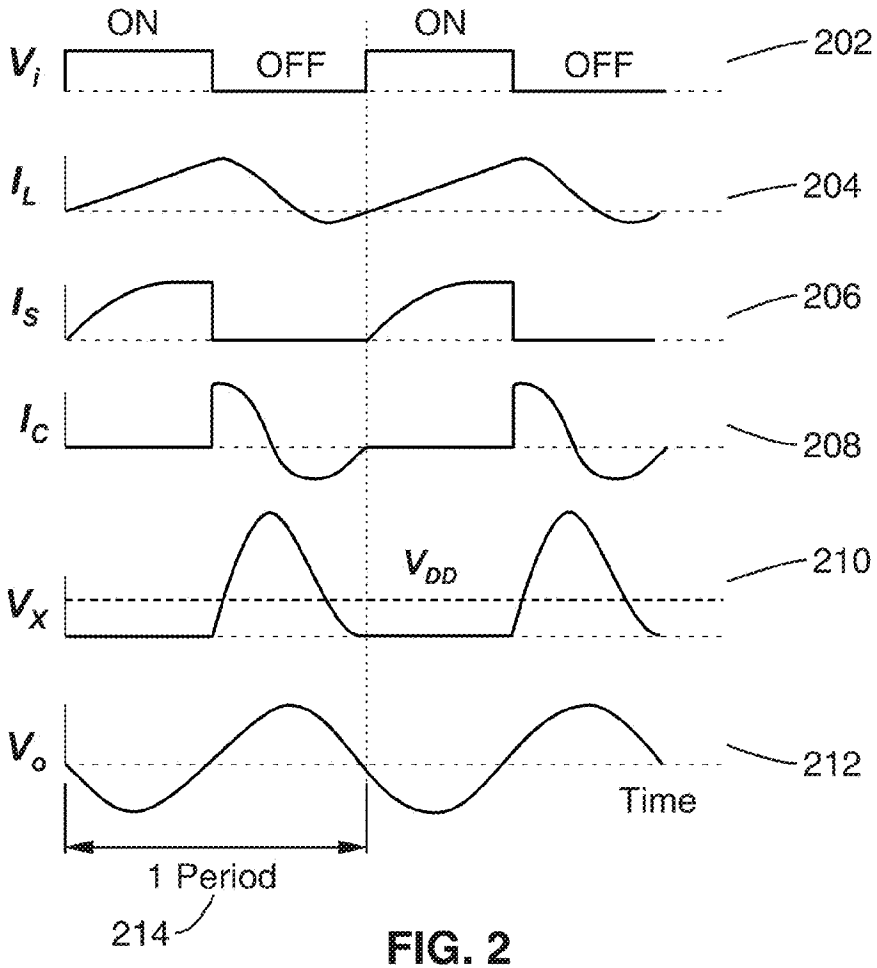
FIG. 2 is a set of time-based plots of voltages and current through two periods of operation of the device shown in FIG. 1A.

Referring now to FIG. 2 and FIG. 1A, the operation of the circuit in FIG. 1A is summarized succinctly by simultaneous voltage and current waveforms in FIG. 2. Here, the fundamental concept behind Class E operation is illustrated, where at no time is the current $I_S$ and voltage $V_X$ across the switching device simultaneously large (hence not dissipating large quantities of power). Plot 202 shows two cycles of the switching device 108 turned on and off. When the switching device 108 is turned on, current $I_L$ 116 initially ramps up a current flow through the $L_{choke}$ inductor 114. Plot 204 shows that the inductive energy stored in $L_{choke}$ inductor 114 is then used during the switch 108 off cycle, hence current $I_L$ 116 decreases when the switch 108 is off. Plot 206 shows the current present in the switch 108, which is only present when the switch is on. Plot 208 shows that storage capacitor $C_1$ 120 has current flowing only when the switch 108 is off. Plot 210 shows that the voltage $V_x$ 112, which is switched to ground, has zero voltage while the switch 108 is on, yet swings above the supply voltage $V_{DD}$ 118 when the switch 108 is off. Finally, in plot 212, the voltage $V_O$ 130 is shown over two periods 214. Comparisons between $I_S$ 206 and voltage $V_X$ 210 show that the switching device 108 is never required to dissipate high power, as it appears that significant voltage across switch device 108 (voltage $V_x$ 112) occurs when switching current $I_S$ 206 is at or near zero.

Since power is equal to the product of current and voltage, this strategy insures that very little power is consumed or lost to the switch device, meaning that a larger percentage of the supply power actually goes to the output load $R_L$ 128. In addition, capacitance charging/discharging losses are minimized by designing the resonator (i.e., the LC tank formed by $L_2$ 126 and $C_2$ 124) to return to zero voltage at the instant the switch is turned on. If the waveforms can be maintained as shown in FIG. 2, then the drain efficiency of this circuit, can actually approach 100% as defined by:

$$\eta = \frac{P_O}{P_S} = \frac{P_L}{P_S} \tag{1}$$

where η is the efficiency, ranging from 0-1, $P_O$ is the output power, $P_S$ is the power drawn from the supply, and $P_L$ is the power delivered to the load.

With ideal switches, the power added efficiency (PAE) of this device, defined by:

$$PAE = \frac{P_L - P_I}{P_S} \quad (2)$$

where PAE also ranges from 0-1, and $P_I$ is the input power. PAE may also be very good, and may again approach 100%. In reality, however, device non-idealities prevent actual Class E amplifier implementations from achieving PAE's anywhere near 100%. The offending non-idealities are generally rooted in the deficiencies of semiconductor-based switching devices typically used in the amplifier circuit, as summarized in the left column of Table 1.

Transistor Switch Deficiencies

Among the items listed in Table 1, the two that most seriously degrade the power added efficiency (PAE) of the amplifier are those in the first two rows, which can be expanded as follows.

In Row 1, the breakdown-limited voltage range of semiconductor transistors limits the usable supply voltage, thereby forcing the load impedance $R_L$ to a smaller value for a given amount of power delivered. For example, in the circuit of FIG. 1B, if the load $R_L$ 152 driven directly by the power amplifier circuit were 50Ω, then the drain voltage amplitude $V_D$ would need to rise as large as 14.14V to deliver 2 W of average power to the load $R_L$.

This 14.14V voltage is too high for many modern semiconductor transistors. To remedy this, an impedance transforming network is often used to transform the actual 50Ω load to much lower impedances presented to the transistor. For example, to deliver 1 W of average power with a zero-to-peak drain voltage of 2V, a 50Ω actual load would need to be transformed down to 2Ω. The problem with this reduction of load impedance is that with a smaller effective load resistance $R_L$, the parasitic resistors associated with the choke inductor $L_{choke}$, the LC tank network, the transistor switch itself, and even the metal interconnects, now add up to a value that rivals $R_L$, which means that as much power is being dissipated into parasitic loads as into the load $R_L$. The transforming network itself will also contain further parasitic resistances that will introduce still more losses. All of these losses then operate to reduce efficiency, since more of the total available power is dissipated in parasitic resistors instead of being delivered to the load. In this respect, a power amplifier that could directly drive larger impedances would be much less susceptible to parasitic losses, hence, much more efficient.

Row 1's semiconductor performance is contrasted with the resoswitch, which is capable of directly driving much smaller load resistances $R_L$ without the need for an impedance transforming network. Since the resoswitch, while switching, is not operating as a semiconductor device, greatly larger switched $V_{DD}$ voltages are capable of being used.

Row 2 of the semiconductor-resoswitch comparison says that in order to achieve a sufficiently low on-resistance, the switching transistor used in a Class E amplifier topology must have very large dimensions (e.g., several mm's), which results in an enormous input capacitance and consequent drain capacitance. Often, the input capacitance can be as large as 10-20 pF, which then requires that the driver device 134 depicted in FIG. 1B consume considerable power just to drive the input capacitance of the switch transistor 140 at the needed amplitude and frequency. This excessive input power consumption then significantly degrades the PAE of the overall power amplifier, generally reducing the efficiency by ~10% or more. Removing the need to drive such a large input capacitance is instrumental in attaining the PAE goals of the high efficiency Class E amplifiers.

The remaining deficiencies in Table 1 are generally self explanatory and include losses due to the low resistance substrate generally used for semiconductor devices, transistor leakage currents, and the fairly complex fabrication process technologies normally needed for semiconductor devices.

It should be noted, however, that if one is already fabricating CMOS devices, then it appears trivial to incorporate resoswitches directly within a single chip. Of course, the resoswitches may also be separately fabricated, and then used discretely as needed. The ability to fabricate a resoswitch monolithically with CMOS drive circuitry yields an extremely attractive microminiaturized package capable of very high functional efficiencies.

Microelectromechanical (MEMS) Resonator-Switch

Recent advances in MEMS-based vibrating micromechanical resonator technology have yielded tiny on-chip disks and rings, vibrating at frequencies over 1 GHz with Q's greater than 10000. These devices have generated great interest in the use of this technology for frequency control and timekeeper applications, especially for communications.

Figure 3B:
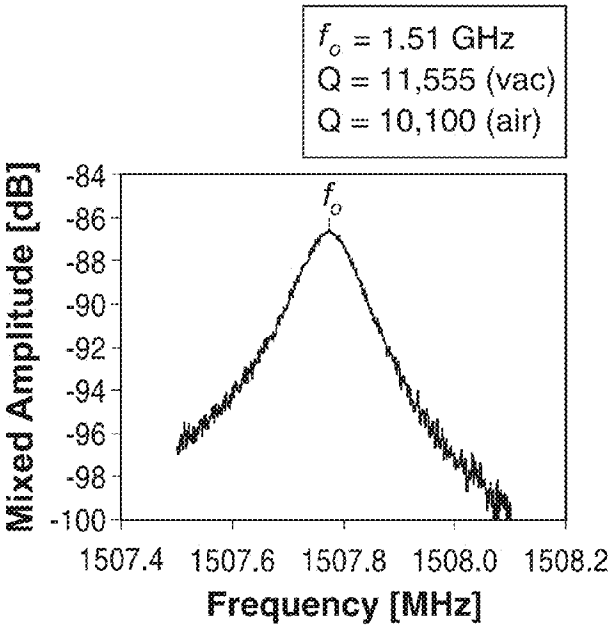
FIG. 3B is a plot of the vibrational amplitude versus frequency of the device of FIG. 3A, indicating a center frequency of 1.51 GHz, with a Q of 11555 in vacuum, and 10100 in air.
Figure 3A:
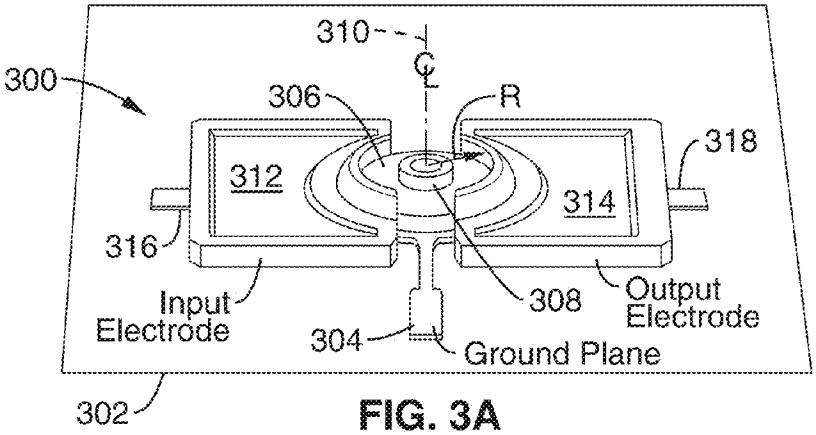
FIG. 3A is a line drawing based on a Scanning Electron Microscope (SEM) image of a MEMS resonator capable of operation at 1.51 GHz with a 10 μm radius, operating in the second radial-contour mode.

Referring now to FIG. 3A, a line drawing of a Scanning Electron Microscope (SEM) image is presented, where a 1.51-GHz radial-contour mode disk resonator 300 achieves an impressive on-chip room temperature Q of 11,555 in vacuum, and 10,100 in air. This device begins with a substrate 302, which may typically be silicon or other convenient material. Upon the substrate 302 ground plane 304 is formed a polydiamond micromechanical disk resonator, which consists of a 20 μm-diameter, 3 μm-thick polydiamond disk 306 suspended above the ground plane 304 and substrate 302 by a polysilicon stem 308 self-aligned to be exactly at the disk 306 center 310, all closely, and nearly completely, circumferentially surrounded by a doped polysilicon input electrode 312 and doped polysilicon output electrode 314 spaced less than 80 nm from the disk 306 outer perimeter. Input electrode 312 is connected to its input through contact 316, while output electrode 314 is connected to its output through contact 318. When vibrating in its radial contour mode, the disk 306 expands and contracts around its perimeter, in a motion reminiscent of breathing, and in what effectively amounts to a high stiffness, high energy, extensional mode. Since the center 310 of the disk 306 corresponds to a nodal location for the radial-contour vibration mode shape, anchor losses through the supporting stem 308 are greatly suppressed, allowing this design to retain a very high Q even at this UHF frequency.

Furthermore, due to the difference in geometries and compositions of the disk 306 and stem 308, resonant frequencies differ, as well as acoustic impedances. Therefore, very little vibrational energy is transferred to the stem 308 through the vibration of the disk 306.

Referring now to FIG. 3B, the measured frequency characteristic for the radial-contour mode disk resonator of FIG. 3A is presented. It is found that this resonator, when tested, achieves resonance at an astounding 1.51 GHz! It is to be noted here that there is no impact of the disk 306 and the input 312 or output 314 electrodes.

The high frequency, high Q attributes of such devices are useful for not only frequency selection and generation functions in wireless circuits, but also power amplifier switch functions. In particular, if the resonator is driven so hard that it impacts its electrodes, then every impact corresponds to the closing of an electrode-to-resonator switch—and a very low resistance one at that, since the mechanical resonator may be constructed of metal, if needed. This high frequency operational switching capability allows for the operation of very high efficiency class E amplifiers and power converters at radio frequencies, and would likely result in correspondingly improved battery life in cell phone transmit applications.

To delineate which electrodes serve as inputs (i.e., as switch control or gate electrodes) and which as switch contact interfaces (i.e., as the "channel" electrodes), different electrode-to-resonator gap spacings may be specified for the different electrode types.

Figure 4A:
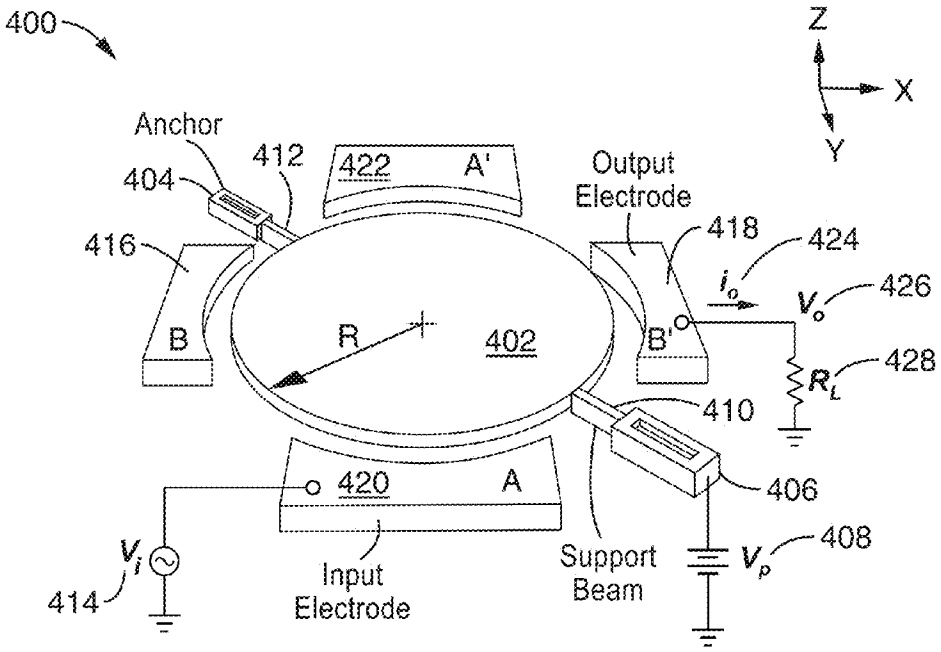
FIG. 4A is a perspective view schematic of a MEMS wine-glass resonator, showing the equations governing the center frequency of operation.
Figure 4B:
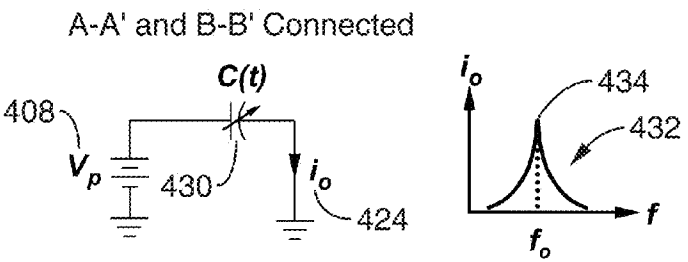
FIG. 4B is a schematic of the current output from the bias voltage coupling to the output electrodes of the resonator of FIG. 4A, as well as a plot of the current versus frequency of the resonator of FIG. 4A.
Figure 4C:
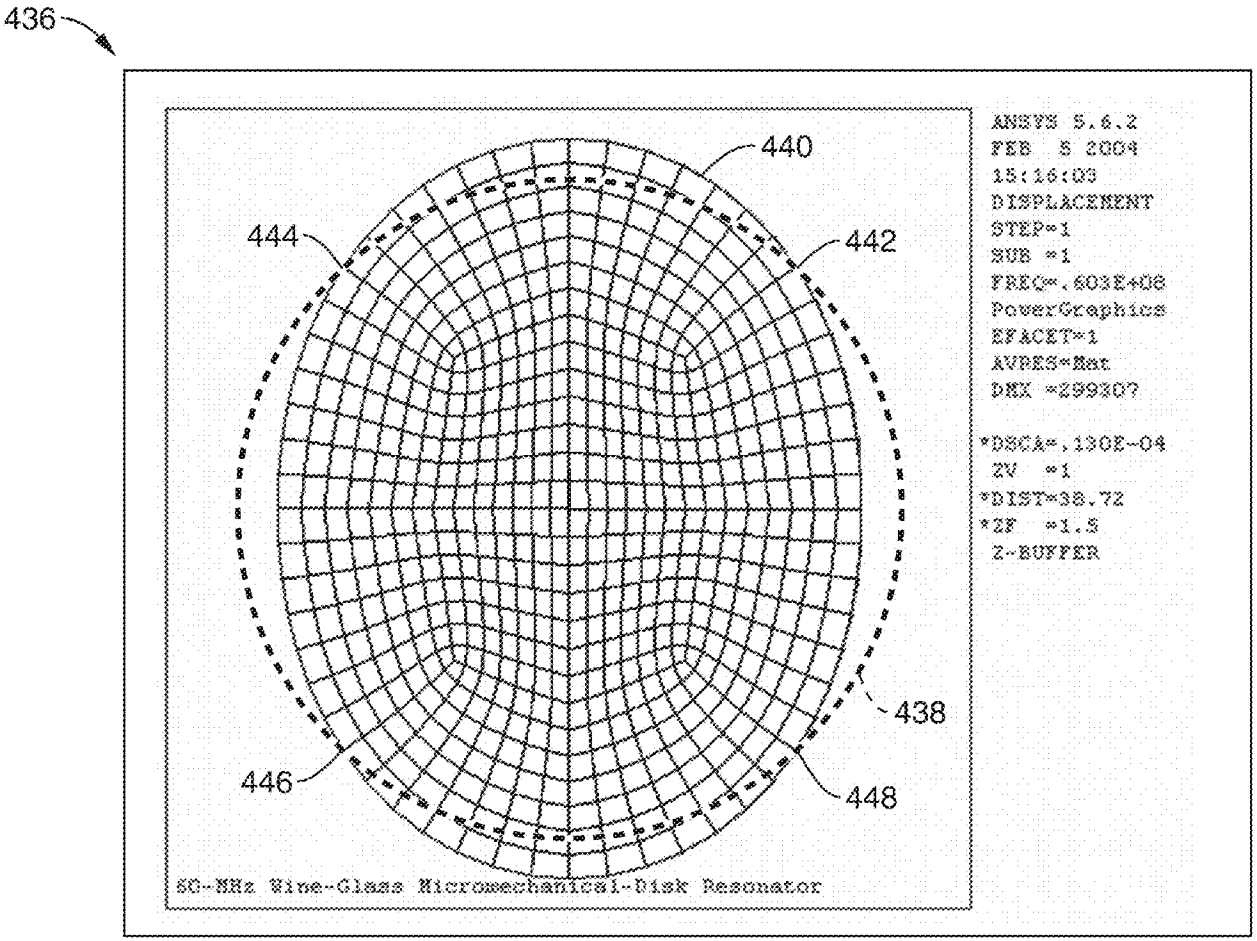
FIG. 4C is an ANSYS finite element analysis of the deflection of the wine-glass mode resonator of FIG. 4A.

Referring now to FIGS. 4A, 4B, and 4C, a wine-glass mode resonator 400 is shown. For example, if a wine-glass disk resonator with the mode shape shown in FIG. 4C is utilized as the basic resonator element, then a simple resoswitch can be realized 400 as shown in FIG. 4A. Here, a resonant disk 402 is suspended above a substrate (omitted for clarity), and anchored by anchors 404 and 406. Anchor 406 is biased 408 at voltage $V_P$. The physical connection between the anchors 404 and 406 and the disk 402 are accomplished by beam support 410 that connects anchor 406 and disk 402, and beam support 412 that connects anchor 402 and disk 402. Beam support 410 is sufficiently conductive to pass bias voltage $V_P$ 408 to the disk 402.

An input voltage source $V_i$ 414 is applied to the resonator. Small electrode-to-resonator gaps are used for electrodes along the x-axis to allow the resonator disk 402 to quickly impact and make electrical contact to output electrodes 416 and 418 thereby establishing a switch contact axis. Conversely, large gaps are used for drive input electrodes 420 (which has input voltage source $V_i$ 414 applied to it) and 422 along the y-axis to allow the drive electrodes to excite the resonant switch 400 without contacting the disk 402, thereby establishing non-intrusive control inputs.

Essentially, in this resonator structure 400, control (or gate) drive electrodes 420 and 422 (that are more distant from the disk 402) are used to the drive the disk 402 into its resonance mode shape, where, at sufficient amplitude the disk 402 impacts the closer contact output electrodes 416 and 418 along the x-axis, periodically closing the switch 400 at a frequency equal to the vibrational frequency of the disk 402.

The periodic closing of the switch 400 gives rise to an output current $i_o$ 424 at voltage $V_o$ 426 through a resistive load $R_L$ 428. Of course the load could also be reactive.

It should be noted that although the high Q of the resonator element 402 in the resoswitch device helps to increase gain and thereby lower the required input drive, one might at first glance think that this high Q might also constrict too much the input bandwidth of the device. This is actually not the case. In fact, when the device is driven sufficiently high enough to instigate impact of the resonant disk 402 with the switch electrodes 416 and 418, this impacting limits the vibrational amplitude of the disk 402, generating a frequency response that is effectively limited as shown in FIG. 4B. The input bandwidth of the device when impacting is much larger than the original 3 dB bandwidth of the resonant disk 402 alone. For example, if a 1 GHz disk 402 has a noncontact 3 dB bandwidth of 100 kHz, then resoswitch limiting can increase this bandwidth to 2-5 MHz, depending on how hard the device is driven. 2-5 MHz is wide enough to typically satisfy all modulation schemes in present use by commercial communication systems.

However, if an even wider bandwidth is desired, methods exist in this patent for this as well. In effect, the resoswitch device uses a nonlinear principle (of constrained vibration) to benefit from both the high-Q of the resonator, which lowers the required input voltage amplitude; and motion constraint, which increases the effective input (i.e., modulation) bandwidth.

In practical use, if a DC-bias voltage $V_P$ 408 is used, the simple resoswitch of FIG. 4A requires that the bias voltage be applied to the resonant disk 402 through the support beam 410 and anchor 406. (Note that a DC-bias is actually not necessary, since the resoswitch could also be driven by a sufficiently large $V_i$ 414 and zero $V_P$ 408, in which case the drive force would be proportional to $\frac{1}{2}V_i^2$, instead of $V_P V_i$.) If it is not convenient to supply a DC-bias $V_P$ 408 to the resonant disk 402, then a more advanced resoswitch design (later shown in FIG. 6A) could be used, as will be described later.

In practice, control input electrodes 420 and 422 (respectively marked as A and A') are electrically connected, as are the output switch electrodes 416 and 418 (respectively marked as B and B').

FIG. 4B relates to the non-contacting performance of the disk 402 under free oscillation. FIG. 4B first contains a schematic of the bias voltage $V_P$ 408 providing a DC-bias to the disk 402. The small distances between the disk 402 and the output switch electrodes 416 and 418 (since 416 and 418 are electrically connected) give rise to an equivalent capacitance C(t) 430, through which an output current $i_o$ 424. Here, the resistive load $R_L$ 428 is taken to be zero, so is omitted. The right portion of FIG. 4B shows the non-contacting output current $i_o$ 424 versus frequency as a typically peaked bandwidth curve 432 with a resonant frequency $f_o$ 434 as the peak value.

FIG. 4C is an ANSYS plot 436 of the resonant disk 402 prior to any physical contact. Note that the ANSYS plot is 90° rotated from the view shown in FIG. 4A. Here, the free, non-vibrating disk 402 is shown as dashed circle 438, and the deformed vibrational shape shown as the finite element mesh 440. Nodal null points 442, 444, 446, and 448 remain at the same geometric position regardless of vibration, hence are ideal locations for anchor supports.

Referring now to FIG. 5A, one rendition of a MEMS resoswitch based on a wine-glass disk geometry is shown with large and small electrode-to-resonator gap spacings that define the control electrodes and switch contact terminals 500. Here, the resonator disk 502 is shown centered between one switch contact electrode 504 (denoted as the Source, S), and the other switch contact electrode 506 (denoted as the Drain, D). Additionally, the disk 502 is centered between control electrodes 508 and 510, both denoted as Gates, G. Both of the Gates 508 and 510 are electrically connected 514, typically through a bridging structure 512 above the disk 502 (not shown for clarity). The disk 502 is vertically suspended above a substrate (not shown) by post 514.

When vibrating, the disk 502 deforms to the dotted curve 516, which indicates the contorted shape taken by the disk 502 in its wine-glass mode that effects contact between the S 504 and D 506 terminals. In an equivalent switch circuit schematic 518, the switches are meant to close simultaneously when driven to sufficiently high amplitude vibration. (Note also that the circuit schematic 518 models only the switch function of the resoswitch, but not the resonator function. A more complete circuit model is still being developed at this time.)

Referring now to FIG. 5B, a curve 520 of the frequency response of this resoswitch in constrained and unconstrained modes versus frequency is shown. Here, it is shown that the constraining mechanism basically governs the resonator 500 input (modulation) bandwidth 522. The impact limiting constraint mechanism provides a much wider effective bandwidth than the 3 dB bandwidth of the high-Q disk 502 would otherwise permit in unconstrained operation.

Referring now to FIG. 5C, we see a line drawing of a Scanning Electron Microscope (SEM) image 524 of a fabricated device of FIG. 5A. Here, the resonator disk 526 is supported by beams 528, 530, 532, and 534, all of which are mounted to respective anchors (not numbered). Source contact 536 connects to external circuitry through trace 538, and Drain contact 540 connects to external circuitry through trace 542. A first Gate electrode 544 connects through a bridge 546 suspended above disk 526 to the second Gate electrode 548. Both Gate electrodes 544 and 548 are electrically connected to external circuitry through contact 550.

Referring now to FIG. 5D, the clearances between the resonant disk 526 and the Drain contact 540 are quite small, about 100 nm. This region 552 is blown up and shown here in FIG. 5D. We see that the resonant disk 526 has both the Drain contact electrode 540 and Gate 544 formed around the circumference of the disk 526 up to its upper surface. The disk 526 has one of four supports with the small floating beam 530. Most importantly in this drawing, the clearance 554 between the resonant disk 526 and the Gate contact electrode 544 is only 100 nm. This particular clearance 554 dimension (with the same clearance between the disk 526 and Source contact 536) sets the bandwidth characteristics of this resoswitch.

A characteristic of decreasing bandwidth would be discernable when the clearance 554 increases through contact wear. Thus, it is likely that a test of the bandwidth of the device would indicate its state of wear. A completely worn out, and likely nonfunctional device, would have the unconstrained motion of the freely vibrating disk previously described.

Referring now to FIGS. 6A and 6B, an input radial-contour mode vibrating disk is coupled via a non-conductive beam to an output disk at a notched location 600. This more advanced resoswitch design features two resonant disks coupled by a non-conductive beam. Here, an input 602 drives an electrode 604 to a radial-contour mode input disk resonator 606, which may be biased at some voltage 608. A non-conductive mechanical coupling beam 610 would then be used to connect the vibrational motion of the input disk 606 to the radial-contour mode output switch resonator disk 612. The input disk 606 can accept a DC-bias while allowing the output resonator switch disk 612 to remain floating, as may be required. In addition, the mechanical coupling 610 from a sidewall surface location on the input disk 606 to a notched location 614 on the switch output disk 612 provides both bandwidth widening and mechanical gain (i.e., amplification) of the composite device 600. Symbolically, a switch having a Gate 602, Source 618 and Drain 616 may be used to depict this device 620.

The coupled structure of FIG. 6A appears to offer several advantages.

First, if the mechanical coupling beam 610 were constructed of a non-conductive material, a DC-bias 608 could be applied to the input disk 606 while allowing the switch output 612 disk to electrically float, as needed.

Second, the mechanical coupling beam 610 between disk resonators 606 and 612, which is similar to that used in the micromechanical filters, operates to widen the effective input bandwidth of the overall structure 600 to a point even beyond that achieved by the switch impacting of the single resonator resoswitch of FIGS. 5A-5D. As illustrated in FIG. 6B, the bandwidth widening here occurs via pole splitting by the coupling beam, where the resonant peaks of the resonators are split apart by a distance proportional to the coupling beam stiffness. Thus, the bandwidth is now determined by the coupling beam dimensions and attachments to the resonators and can be made quite wide, perhaps up to 100 MHz wide, as needed. Further, the beam 610 could be specifically designed to act as an additional coupled vibrating element, thus giving rise to a three or more pole and/or zero system, with even broader frequency or tuning characteristics.

Third, the connection of the coupling beam 610 from a sidewall location of the input disk 606 to a notched location 614 at the switch output disk 612 effectively amplifies the mechanical motion of the switch output disk 612 relative to the input disk 606; i.e., this effectively realizes mechanical displacement gain or amplification, much like a lever! This allows the electrode-to-resonator gap spacings for the input 606 and switch output disks 612 to be the same, since the input disk's 606 non-impacting amplitude will now be much smaller than that of the switch output disk 612, allowing the input disk 606 to operate without impacting while retaining the same gap spacing as the switch output disk 612 (which does impact due to higher vibrational amplitude).

Note that the device of FIG. 6A is the one depicted schematically in the Class E circuit of FIG. 1C. However, such device could be the much simpler device of FIG. 5A. The device of FIG. 6A is currently undergoing further development.

Noteworthy is the option of using a nonconductive substrate (such as sapphire) for the resoswitch power amplifier towards even further loss reduction. The cheaper process technology (from a mask count perspective and fabrication cost) is equally noteworthy, as is the potential for monolithic wafer-level integration of micromechanical resoswitches directly atop CMOS—something that is not presently possible for GaAs switches.

Differences Between the Resoswitch and RF MEMS Switches

Given the spotty history of reliability for the more conventional radio frequency (RF) microelectromechanical systems (MEMS) switches targeted for antenna switching applications (e.g., phased array antennas), it is instructive to emphasize the differences between the proposed micromechanical resoswitch and previous RF MEMS switches. Table 2 directly compares the resoswitch with the RF MEMS switches, clearly showing that because the resoswitch operates at resonance, the resoswitch:

1) is considerably faster than a conventional RF MEMS switch, with switching times commensurate with its resonance frequency (i.e., ns switching times for GHz frequencies);

2) requires a much lower drive voltage due to its use of high Q resonance, which allows drive voltages on the order of mV's rather than the >50V actuation voltages often required for RF MEMS switches; and perhaps most importantly, 3) should be substantially more reliable than an RF MEMS switch, because the restoring force that breaks the switch contact is many orders of magnitude larger for the resoswitch than for a conventional RF MEMS switch. In addition, the time over which contact occurs is in the nanosecond range, thus, many times smaller than the 10's of microseconds or longer typical of RF MEMS switches.

The last of the above is perhaps the most important. It is well known that the cycle lifetime of a conventional RF MEMS switch is often limited by contact sticking forces that eventually hold the switch down after a large number of cycles, preventing the switch from breaking contact when the switch actuation voltage is released. For direct contact switches, this sticking can occur via fusing of the switch structure to its electrode after many cycles. For capacitive switches, where a dielectric material is inserted between the switch and its electrode, charging of the dielectric can eventually lead to an electrostatic force that holds the switch down, again preventing it from breaking contact when the actuation voltage is released. The rapidity by which these sticking mechanisms can lead to switch failure is a strong function of the restoring force generated by the switch structure, which is basically governed by its stiffness. For conventional RF MEMS switches that operate off-resonance, the switch stiffness is generally made small, on the order of 1 N/m, in order to reduce the voltage required for actuation. On the other hand, since the resoswitch operates at a very high Q resonance state, the required drive voltage can be small (~mV's) even when the resonator structure has a very large stiffness on the order of ~70 MN/m (which is a common value for GHz micromechanical disks). This stiffness, about 7 orders of magnitude higher than that of a conventional RF MEMS switch, implies a restoring force also 7 orders higher. With a restoring force this high, it is possible that the resoswitch will not suffer at all from sticking of the switching contacts.

There is some concern, however, for failure due do simple wear after many impact cycles. Although previously published work on impact testing for silicon and metal MEMS devices seem to indicate that impact wear will likely not be an issue, such a failure mechanism still needs to be addressed.

Comparison With State-of-the-Art

To better quantify the performance gains afforded via the resoswitch design of FIG. 1C, Table 3 compares important power amplifier metrics for two transistor designs, one based on silicon CMOS (the CMOS PA) and one on GaAs (the GaAs PA), with those expected for a micromechanical resoswitch-based version. The 25% potential gain in PAE of the resoswitch over the GaAs version would lead to an unprecedented PAE of 95% at the stated frequency. Gains on this order would make possible substantial increases in the battery lifetimes of portable communication devices and unattended ground sensors, alike, as well as increases in the range of such devices.

Technical Challenges

Perhaps the biggest challenge in resoswitch work is the actual physical implementation of a suitable micromechanical resoswitch device.

Refer now to FIGS. 7A-7C, where the cross sections of the simple device of FIG. 7C 700 are shown prior to (FIG. 7A) 700, and after (FIG. 7B) 702 the removal of the oxide layer. Here, in FIG. 7A, the cross section of the resoswitch device 700 is shown with the materials listed so as to facilitate lithographic mass fabrication. FIG. 7B is a cross section 702 of the device of FIG. 7C after the removal of the oxide layer by immersion in an HF bath 704. FIG. 7C is a representative single disk resoswitch.

It is seen here that the gap 706 between the resonator disk 708 and the electrodes 710 and 712 is produced through the HF etching 704 of the oxide layer 714 particularly in the gap 706 regions between disk 708 and the electrodes 710 and 712.

Indeed, although at first glance this device appears very similar in structure to disk resonators already discussed, there are two important differences that might require a substantial redesign of the fabrication process. These are as follows.

First, the need for different gap spacings for the gate and drain ports of the switch complicates the fabrication process. Specifically, in the present fabrication process for disk resonators, the electrode-to-resonator gap spacing is determined by the thickness of an oxide sidewall sacrificial spacer, as depicted in FIGS. 7A-7B, which shows the last few steps of the fabrication process. Here, sacrificial oxide layers, including sidewall layers, are removed via wet HF etching 704 to release structures that will eventually move. Two different sidewall sacrificial spacer thicknesses are thus required. This may be realized via an additional masking step to allow two sacrificial layer depositions along sidewalls where the larger gap is required. Gap spacings in the actual process will likely be 50 nm for contact terminal gaps, and 200 nm for actuation (i.e., gate) gaps.

Second, it is unclear whether or not the conductivity or contact resistance of polysilicon structural material will suffice for the needed resoswitch device. In particular, if large voltage handling does indeed allow direct driving of a 50Ω or higher load impedance, then 1-3Ω of combined contact/series resistance, which should be achievable by heavily-doped polysilicon, should still allow very good PAE, exceeding 90%. If, however, the doped polysilicon contact resistance is excessive, to the point where fusing or contact degradation becomes a problem, then a metal structural material might be needed. A nickel or copper metal structural material may be used.

The metal process is not as mature as the polysilicon one, so more work would be needed to adjust the process to allow for multiple gap spacings. In addition, there are opportunities for exploration of new methods for metal deposition, such as nano ink jet approaches that could introduce alloying flexibilities not presently available via electroplating.

Beyond fabrication issues, there are also, of course, design and performance challenges. In particular, the Class E topology used in the example of FIG. 1C might indeed not be the optimum design when using micromechanical resoswitches. For example, one might dispense with the choke inductor of FIG. 1C and instead use a complementary resoswitch device to yield the Class D topology shown in FIG. 8. This has the advantage of removing the series resistance of the choke inductor and should be fairly straightforward to implement, since the complementary resoswitch shown should have identical performance to the lower resoswitch in FIG. 8. (Note that this is not the case for semiconductor switches, where the complementary p-type devices are normally inferior in performance to n-type devices.)

Referring now to FIG. 8, a Class D amplifier is shown realized with resoswitches 800. Here, a driver 802 drives from input voltage waveform $V_s$ 804 to produce $V_i$ 806 on the control electrodes of resoswitches 808 and 810. Resoswitch 808 has a 180° phase-shifted contact electrode 812, meaning it is spatially 180° opposite the driver electrode. Contrastingly, resoswitch 810 has a 90° phase-shifted contact electrode 814, meaning it is spatially rotated 90° relative to the driver electrode. These resoswitches 808 and 810 functionally act as the equivalents to PNP and NPN transistor pairs in a transistor Class D amplifier, but likely with improved performance. The contact electrodes 812 and 814 connect with $C_1$ 816 (which then passes to ground) and the familiar series LC tank circuit of $C_2$ 818 and $L_2$ 820. The output of the series LC tank circuit then feeds load $R_L$ 822, producing output voltage $V_o$ 824.

For the case of micromechanical resoswitches, even greater performance advantages could be attained if the mechanical circuit design were to be utilized to improve the matching or change the phasing of the two complementary resoswitch devices 808 and 810 of FIG. 8.

Referring now to FIG. 9, a schematic of a wine-glass disk resoswitch structure used in an example circuit diagram of a Class-E power amplifier utilizing this resoswitch is shown 900. As shown in FIG. 9, this device comprises a wine-glass mode disk resonator 902 similar to those previously used for oscillator and filter applications, but now driven harder so that its conductive disk structure impacts surrounding electrodes. Connected input electrodes 904 and 906 drive the resonator disk 902 from a voltage source 908. Bias voltage 910 is fed to the resonator disk 902 through an inductor 912, which acts to electrically isolate the DC bias voltage 910 from the connected output electrodes 914 and 916. The output electrodes 914 and 916 then feed storage capacitor 918, which is connected to ground, as well as series inductor 920, which is resistively loaded to ground 922. Output voltage $v_{out}$ 924 is produced as the series inductor 920 feeds the load resistor 922.

The vibration of the resonator disk 902 electrically shorts the disk and output electrodes 914 and 916, thereby effecting periodic on/off switching at the disk's 902 resonance frequency. By harnessing the resonance and nonlinear dynamical properties of their mechanical structures, resoswitches achieve significantly lower actuation voltage (~2.5V), much faster switching speed (rise time ~4 ns), and substantially longer cycle lifetimes (>16.5 trillion cycles), than conventional MEMS switch counterparts, making them far more suitable for applications where periodic switching is needed.

Referring now to FIG. 10A, the conventional disk resonator 1002 is shown. In this set of examples, the disk resonator 1004 has a radius of 32 μm. The performance of this disk resonator 1002 has several disadvantages, such as the vibration amplitude of the "on" and "off" states is the same. Thus, if it is desired to contact the switch electrodes in a resoswitch during the "on" state, the gate, or control electrodes would also be contacted during the "off" state. One solution to this difficulty would be to change the gap distances between the resonator disk and the electrode, to where the control or gate gap is larger than the contact switch gap. However, the fabrication of these different gap sizes is problematic during device fabrication.

Referring now to FIG. 10B, an improved disk resonator 1006 with the same disk 1008 resonator dimensions of FIG. 10A, with a radius of 32 μm, is shown. To this device have been added two obround displacement gain features 1010 and 1012, which both have dimensions of 5 μm×16 μm. These displacement gain features 1010 and 1012 operate to amplify the displacement of the disk 1008 vibrational amplitude in the region of the displacement gain features.

Referring now to FIG. 10C, a plot 1014 of mode shape comparison between the conventional disk resonator displacement curve 1016 of FIG. 10A and the displacement gain resonant disk curve 1018 of FIG. 10B are shown. Here, the radial displacements are normalized to the maximum displacement of the conventional disk resonator. It is observed that the displacement of the displacement gain resonant disk curve 1018 of FIG. 10B is some three times in amplitude when compared to the conventional disk resonator curve 1016.

Referring now to FIGS. 10B and 10C, since the displacement gain features 1010 and 1012 of FIG. 10B result in three times the displacement 1018 of the conventional resonator curve 1016, it is apparent that the gaps between the resonator and the control and switch electrodes may now be maintained at the same distance, while displacement gain elements 1010 and 1012 may be added to those switch electrodes where resonator contact is desired.

Although in this example, slots 1010 and 1012 were shown as removal of material, the oscillator disk 1008 could have had material added in the same shape. This would have resulted in decreased displacement in the vicinities of additive slots 1010 and 1012. Furthermore, such added material would likely have required additional processing steps during fabrication.

Referring now to FIG. 10D, we see a top view of two cascaded displacement gain devices described in FIG. 10B 1020. Here, a first displacement gain device 1022 with displacement gain elements 1024 connects to a second, 90° rotated displacement gain device 1026 with displacement gain elements 1028 interconnected with beam 1030. The operation of this device will be further elucidated below.

Referring now to FIG. 10E we see line drawing from a Scanning Electron Microscope (SEM) image of the displacement gain device of FIG. 10B 1032. Here, the disk resonator 1034 is excited by input control electrodes 1036 and 1038. During operation, output switch electrodes 1040 and 1042 are contacted with the disk resonator 1034, causing closure of the switch device 1032. Displacement gain features 1044 and 1046 causes a gain in vibrational displacement of the disk resonator 1034 in the regions of the output switch electrodes 1040 and 1042. Thus, even when gap spacings are the same from the resonator disk 1034 to the input control electrodes 1036 and 1038 and the output switch electrodes 1040 and 1042, contact only occurs on the output switch electrodes 1040 and 1042.

During testing, the slotted disk resonator exhibited input-to-output displacement gain factor of 3.07 over the basic resonator geometry of FIG. 10A.

Referring now to FIG. 10F, we see a Scanning Electron Micrograph (SEM) of the displacement gain device of FIG. 10D 1048. Here, the first displacement gain resonator 1050 is connected to a second displacement gain resonator 1052 through a half wave beam coupler 1054. First displacement gain resonator 1050 has displacement gain features (here obround slots) 1056 and 1058 in line with the half wave beam coupler 1054. The second displacement gain resonator 1052 has displacement gain features (here obround slots) 1060 and 1062 90° out of line with the half wave beam coupler 1054.

In operation, the first displacement gain resonant disk 1064 produces a gain amplification that is transmitted through the half wave beam coupler 1054 to the second displacement gain resonant disk 1066. The half wave coupler 1054 is designed so that, at the resonant center frequency of the first gain stage 1050 and the second gain stage 1052, a maximum positive compressive force generated by displacement gain feature 1058 is transmitted as a maximum negative compressive (pulling) force to the resonant disk 1066 of the second gain stage 1052, thereby amplifying even further the effect of the gain displacement features 1060 and 1062 of the second gain stage 1052.

The half wave coupler 1054 has a length calculated by $$L_{coupler} = \frac{1}{2}\frac{\sqrt{\frac{E}{\rho}}}{f_0},$$

where $L_{coupler}$ is the coupler length, E is the Young's modulus of the coupler material, ρ is the coupler material density, and $f_0$ the center frequency of operation.

During testing, the case of two cascaded gain stages, the displacement was amplified by a factor of 7.94, from input to output over the basic resonator geometry of FIG. 10A.

Experimental Results

To demonstrate the resoswitch, doped polysilicon wineglass mode disk resonators were employed. FIG. 5C, presented earlier, presents a line drawing of the Scanning Electron Micrograph (SEM) of one of the 61-MHz wineglass disk resonators used here, with a zoom-in (FIG. 5D) showing the tiny gap between the disk and its switch electrode. For most power amplifier and converter applications, the resoswitch should be constructed of metal, not polysilicon, to reduce its contact and series resistance.

The use of doped polysilicon does compromise resoswitch performance, especially with regards to the switch "on" resistance, which is dominated by the 1.1 kΩ parasitic resistance $R_p$ of its polysilicon leads and interconnects. Nevertheless, it still allows demonstration of practically all other important resoswitch performance parameters. It should be noted that, despite its high series resistance, the polysilicon version of the resoswitch is actually still quite applicable for use in low current drain switched-mode on-chip DC-to-DC power converters (i.e., charge pumps), such as needed to supply the large DC-bias voltages often required by vibrating resonators and RF MEMS devices.

For simplicity in this early demonstration, the strategy of using different electrode-to-disk spacings along the input and switch axes previously shown in FIG. 4A was not used in this implementation. Rather, the electrode-to-resonator gap spacings for both axes were 100 nm for direct contact switches, in which the conductive disk and electrode materials actually make electrical contact; and about 97 nm for capacitive switches, in which a thin layer of oxide exists over conductive surfaces that pre-vents electrical contact, but still allows switching through the large capacitance that results when the disk impacts its switch electrodes.

For the direct contact version of the resoswitch, one obvious consequence of the use of identical input and switch axis electrode-to-resonator gaps is that the input electrodes tend to get shorted to the disk during operation, which then complicates use of the resoswitch in actual applications. (For example, the Class E power amplifier topology previously shown in FIG. 1B would not be permissible under these conditions.)

Referring now to FIG. 11A, a schematic of a test setup used to measure resoswitch performance and deal with input shorting is shown 1100. Here, the device 524 of FIG. 5C is used for testing purposes. This implementation is a less practical configuration, but one still valid for evaluation of switch performance. Here, a DC-bias voltage $V_P$ 1102 is applied to the disk structure 526 through limit resistor 1104 through anchor beam 534 that is effectively applied to the output electrodes 536 and 540 when the switch 524 closes (i.e., comes "on"). As shown, this circuit allows both time domain 1106 (i.e., oscilloscope) and frequency domain 1108 (i.e., spectrum analyzer) observation of the resoswitch 524 output. The output buffer 1110 used in this circuit effectively removes the 80 pF of coaxial capacitance that would otherwise load the output node of the resoswitch and greatly reduce the signal level due to 3 dB bandwidth roll-off. The output buffer 1110, however, is not perfect, as it still loads the output node of the resoswitch with about 4 pF. This is large enough to round out the corners of the expected output square so that it looks more sinusoidal.

Referring now to FIG. 11B and FIG. 11C, the oscilloscope waveform and swept frequency response spectrum (for various input amplitudes), respectively are shown, of the direct contact resoswitch 524, verifying switching operation, impact limiting, and also the bandwidth-widening effect previously discussed. Switching clearly occurs when the frequency response grows suddenly and limits with a "flat top", as shown on FIG. 11C. This occurs when the voltage amplitude reaches 2.5V. The measured output signal in FIG. 11B has peak-to-peak amplitudes of about 1V, which is the value expected when considering attenuation via the finite 3 dB bandwidth of the measurement circuit of FIG. 11A, and when considering the voltage divider formed by the parasitic polysilicon interconnect resistance $R_p$ and the bleed resistor $R_{bleed}$.

The output signal is not quite a square wave due to bandwidth limitations of the measurement circuit, but the amplitude is correct. To emphasize this point, FIG. 11B also includes a SPICE simulated waveform that includes the effects of 1.1 kΩ of parasitic resistance $R_p$ and 3.5 pF of buffer input capacitance, and that clearly matches the measured waveform.

Referring now to FIG. 11D a measured plot of the transmitted output power (seen at the switch axis output node 536 and 540) versus frequency is presented. Here, the buffer 1110 of FIG. 11A was not used, so load-induced attenuation somewhat compromised the measurement, resulting in a measured output power considerably lower than in FIG. 11C. Nevertheless, FIG. 11D does verify the nonlinear resonance dynamical behavior of the resoswitch, since the bandwidth does indeed widen as the input voltage amplitude increases.

Referring now to FIG. 11E, a plot of output voltage versus time was constructed. To evaluate reliability, the resoswitch was operated continuously with $V_P$=10V for 75 hours (~3 days or 16.5 trillion cycles) without failure at a frequency of 61 MHz, which is a frequency in the flat region of FIG. 11C, and thus, a frequency where impacting occurs. Although no failure was observed, degradation was seen, where after about 1.5 days, the output voltage began to decrease significantly. Although 1.5 days corresponds to 7.7 trillion cycles at 61 MHz, which is more than two orders of magnitude higher than the 100 billion cycles typically achieved by (good) RF MEMS switches, there is still cause for concern here, since typical switched-mode power applications will require quadrillions of cycles. More study into the degradation mechanism is needed, but one possible reason for the observed degradation could be the growth of a thicker oxide or other dielectric on the switch contact interfaces. In the future, resoswitches constructed of metal with engineered contact surfaces will be investigated.

Conclusion

Although the description above contains many details, these should not be construed as limiting the scope of the invention but as merely providing illustrations of some of the presently preferred embodiments of this invention. Therefore, it will be appreciated that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. 112, sixth paragraph, unless the element is expressly recited using the phrase "means for."

TABLE 1

Semiconductor Switch Deficiencies Improved Via Micromechanical Resoswitches

| Row | Semiconductor Switch Implementation Deficiency | Micromechanical Resoswitch Implementation Solution/Benefit |
|---|---|---|
| 1 | Limited supply voltage dictates a small driven $R_L$ ~2Ω (achieved via impedance transformer) Transformer itself is lossy, and component losses (e.g., $R_S$, $R_{pL}$) become a larger % of $R_L$⇨ lowers efficiency | Larger supply voltage $V_{DD}$ allows large $R_L$ no need for a transformer component losses (e.g., $R_S$, $R_{pL}$) become a smaller % of $R_L$⇨ raises efficiency |
| 2 | To achieve small transistor channel resistance, need large device size⇨ large capacitance C driver device must consume significant power to drive large $C_i$⇨ degrades PAE nonlinear drain C generates spikes of high voltage that degrade device lifetime | Small switch resistance with very little input capacitance $C_i$ ~$10^{-15}$ F much less driver power consumption⇨ much better PAE effective "drain" C orders of magnitude smaller than that of large transistor |
| 3 | Limited breakdown voltage⇨ reliability problem | High pull-in voltage >65 V obviates failure via breakdown |
| 4 | Low resistance substrate adds to total PA loss⇨ poor efficiency | Can use high resistance substrate⇨ less substrate loss⇨ better efficiency |
| 5 | Large input drive needed⇨ reduces PAE | Resonant drive allows very small input drive⇨ better PAE |
| 6 | Leakage currents | No leakage currents when off |
| 8 | Fabrication involves many masks (e.g., >28, for CMOS)⇨ expensive | Fabrication can be done with a 4-5 mask process⇨ inexpensive + can integrate over CMOS, if desired |

TABLE 2

RF MEMS Switch Versus Micromechanical Resoswitch

| Row | Conventional RF MEMS Switch Deficiency | Micromechanical Resonator-Switch Benefit |
|---|---|---|
| 1 | Large actuation voltage, usually >50 V | High Q resonance allows mV-level actuation voltage |
| 2 | Small stiffness ~1 N/m⇨ small restoring force⇨ sticking reliability issues | Large stiffness ~50 MN/m⇨ huge restoring force⇨ sticking not a problem |
| 3 | Large size | Much smaller when built for high frequency |
| 4 | Low switching speed ~1 μs | Much faster switching speed at GHz resonances (i.e., ~ns switching speeds, or faster) |

TABLE 2

Power Amplifier Technology Comparison

| Parameter | CMOS PA | GaAs PA | Resoswitch PA* |
|---|---|---|---|
| Frequency | 2.4 GHz | 5-6 GHz | 2.4 GHz |
| Output Power | 1.9 W | 1.7 W | 1-2 W |
| Supply Voltage | 2 V | 12 V | 10-14 V |
| Power Added Efficiency | 41% | 70% | >95% |
| Transistor Width | ~09 mm | 2.5 mm | <20 μm |
| Switch On Resistance | 0.6Ω | ~1.7Ω | 0.5-1Ω |
| Driven Load Resistance | 0.875Ω | ~42Ω | 50Ω or higher |
| Required Driver Power | ~280 mW | ~250 mW | ~51 μW |
| Input Capacitance | ~20 pF | ~8 pF | 1.4 fF |

*Predicted values.

What is claimed is:

1. A resonating switch apparatus, comprising:

a) a substrate, and b) a driven element that resonates in a driven element radial-contour mode;

c) a switch contact proximal to the driven element;

d) a drive electrode that drives a disk resonator that oscillates in a drive resonator radial-contour mode, wherein the driven element is mechanically coupled to the disk resonator through a nonconductive coupling beam;

e) wherein the driven element contacts the switch contact upon a sufficient amplitude oscillation imparted by the disk resonator.

2. The apparatus of claim 1, wherein the nonconductive coupling beam mechanically couples to the driven element at a notched location in the driven element.

3. A power amplifier comprising at least one of the resonating switch apparatus of claim 1.

4. A power converter comprising at least one of the resonating switch apparatus of claim 1.

5. The apparatus of claim 1, wherein the driven element is polysilicon or a metal.

6. The apparatus of claim 1, wherein the driven element is driven with a voltage amplitude of less than or equal to 3 volts applied to the drive electrode.

7. The apparatus of claim 6, wherein the resonating switch apparatus has a switch closure time of less than 10 ns.

8. The apparatus of claim 6, wherein the resonating switch apparatus has a switch closure time of less than 5 ns.

9. The apparatus of claim 6, wherein the resonating switch apparatus has a switch closure time approximately 4 ns.

10. The apparatus of claim 1, wherein a gap between the disk resonator and the drive electrode is 150 nm or less.

11. The apparatus of claim 1, wherein a gap between the disk resonator and the drive electrode is 100 nm or less.

12. The apparatus of claim 1, wherein a gap between the driven element and the switch contact is 150 nm or less.

13. The apparatus of claim 1, wherein a gap between the driven element and the switch contact is 100 nm or less.

14. The apparatus of claim 1, wherein the driven element has an unconstrained resonant frequency between 61 MHz and 2.0 GHz.

15. The apparatus of claim 1, wherein the resonating switch has a Q of 10000 or greater.

16. The apparatus of claim 1, wherein the resonating switch has a Q of 12500 or greater.

17. The apparatus of claim 16, wherein the resonating switch operates within an ambient gas selected from the group of gasses consisting of: vacuum, air, nitrogen, argon, $SF_6$.

18. The apparatus of claim 1, wherein the resonating switch is monolithically fabricated along with one or more CMOS elements.

19. The apparatus of claim 1, wherein the driven element is substantially circular.

20. The apparatus of claim 1,wherein the driven element is substantially flat.

21. The apparatus of claim 1, wherein the driven element comprises one or more displacement gain elements.

22. A cascaded resonator, comprising two or more of the apparatus of claim 21 interconnected with resonant structures, wherein the bandwidth of the cascaded resonator exceeds the bandwidth of each of the individual oscillating switch apparatus of claim 21.

23. A resonating switch, comprising:

a) a substrate;

b) a driven element spaced above and connected to the substrate;

c) a drive electrode proximal to at least one driven element;

d) a switch contact proximal to at least one driven element;

e) wherein the drive electrode oscillates the driven element at resonance in a radial-contour mode;

f) wherein the driven element periodically electrically connects the switch contact;

g) a physical connection between two or more of the driven elements, wherein the oscillation of at least one of the driven elements is transmitted to at least one other driven element; and h) wherein the physical connection is an insulator.

24. The apparatus of claim 23, wherein the physical connection is disposed above the substrate.

25. The apparatus of claim 23, wherein the physical connection is a beam.

26. A method of signal switching, comprising:

(a) providing a resonant switch apparatus, said resonant switch apparatus comprising:

(i) a substrate, and (ii) a driven element that oscillates at resonance;

(iii) a switch contact proximal to the driven element; and (iv) a drive electrode proximal to the driven element;

(v) wherein the driven element periodically contacts the switch contact upon a sufficient amplitude oscillation imparted by the drive electrode; and (b) driving the driven element, so as to cause vibration of the driven element at resonance in a radial-contour mode.

27. The method of amplifying power of claim 26:

wherein the driven element proximal to the drive electrode is a radial-contour mode input disk resonator biased to a source voltage $V_p$;

wherein the driven element proximal to the switch contact is a radial-contour mode input disk resonator floating relative to the source voltage $V_p$; and providing a non-conductive coupling beam disposed between the biased and unbiased disk resonators.

28. The method of amplifying power of claim 26, further comprising:

using the resonant switch apparatus as a switching element in a Class E amplifier.

29. The method of amplifying power of claim 28, further comprising:

switching a power supply voltage of 10-14volts.

* * * * *